US008931864B2

(12) United States Patent
LaCaze

(10) Patent No.: US 8,931,864 B2
(45) Date of Patent: Jan. 13, 2015

(54) APPARATUSES FOR PRINTING ON GENERALLY CYLINDRICAL OBJECTS AND RELATED METHODS

(75) Inventor: John Randel LaCaze, Hampton Cove, AL (US)

(73) Assignee: INX International Ink Company, Owens Cross Roads, AL (US)

( * ) Notice: Subject to any disclaimer, the term of this patent is extended or adjusted under 35 U.S.C. 154(b) by 756 days.

(21) Appl. No.: 12/785,208

(22) Filed: May 21, 2010

(65) Prior Publication Data

US 2010/0295885 A1 Nov. 25, 2010

Related U.S. Application Data

(60) Provisional application No. 61/180,251, filed on May 21, 2009.

(51) Int. Cl.
*B41J 3/00* (2006.01)

(52) U.S. Cl.
USPC ..... 347/2; 198/689.1; 400/61

(58) Field of Classification Search
USPC ..... 347/2, 5, 9, 16, 3, 4; 400/61; 198/689.1
IPC ..... B41J 13/12
See application file for complete search history.

(56) References Cited

U.S. PATENT DOCUMENTS

| | | | | |
|---|---|---|---|---|
| 4,138,941 | A | 2/1979 | McMillin et al. | |
| 5,029,523 | A | 7/1991 | Fields | |
| 5,799,574 | A | 9/1998 | Williams et al. | |
| 5,831,641 | A | 11/1998 | Carlson | |
| 5,960,933 | A * | 10/1999 | Albrecht | 198/689.1 |
| 6,135,654 | A * | 10/2000 | Jennel | 400/61 |
| 6,257,136 | B1 | 7/2001 | McCoy et al. | |
| 6,523,921 | B2 | 2/2003 | Codos | |
| 6,538,767 | B1 | 3/2003 | Over et al. | |
| 6,746,093 | B2 | 6/2004 | Martinez | |
| 6,811,648 | B1 | 11/2004 | Dominico | |
| 6,913,335 | B2 | 7/2005 | Martinez | |
| 6,923,115 | B1 | 8/2005 | Litscher et al. | |
| 7,011,728 | B2 | 3/2006 | Dewig | |
| 7,111,915 | B2 | 9/2006 | Martinez et al. | |
| 7,210,408 | B2 | 5/2007 | Uptergrove | |
| 7,506,942 | B2 | 3/2009 | Martinez | |
| 7,625,059 | B2 * | 12/2009 | Uptergrove | 347/16 |

FOREIGN PATENT DOCUMENTS

| | | |
|---|---|---|
| JP | 60094355 | 5/1985 |
| JP | 09294954 | 11/1997 |
| WO | WO2004016438 | 2/2004 |
| WO | WO2008132217 | 11/2008 |

OTHER PUBLICATIONS

A.W.T. World Trade, Inc.; Versa-Print.

* cited by examiner

*Primary Examiner* — Lam S Nguyen
(74) *Attorney, Agent, or Firm* — George P. Kobler; Lanier Ford Shaver & Payne P.C.

(57) ABSTRACT

An ink jet printer for printing on an at least partially cylindrical objects comprises one or more printheads positioned above a line of travel and a carriage assembly configured to hold an at least partially cylindrical object axially aligned along the line of travel and to position said object relative to the printheads, and then rotate the object relative to said one or more printheads. The printer also includes a curing device located along the line of travel and configured to emit an energy suitable to cure the deposited fluid.

18 Claims, 35 Drawing Sheets

APPARATUSES FOR PRINTING ON GENERALLY CYLINDRICAL OBJECTS AND RELATED METHODS

CROSS-REFERENCE TO RELATED APPLICATIONS

This application claims priority to U.S. Provisional Application 61/180,251 filed May 21, 2009, and which is incorporated by reference herein.

BACKGROUND

1. Field

The present invention relates generally to printing, and particularly, to printing on cylindrical objects, and more particularly to printing on hollow cylindrical objects, such as cans, and hollow, partially cylindrical objects, such as bottles.

2. Description of the Problem and Related Art

Current methods of printing indicia on cylindrical objects, such as cans or bottles, include either spray painting, gravure application, or the like, as is known in the art. While these methods have great utility in mass production of such objects, they do not lend themselves to other markets, such as novelty advertising on bottles, which benefit from the ability to change designs rapidly.

Ink jet printing is well-known, and because it can be digitally controlled using a computer, it has the flexibility to allow a user to change designs as desired. Only recently, however, have advances in technology been made to enable true image rendering on non-planar objects. For example, U.S. Pat. No. 7,111,915 entitled, Methods and Apparatus for Image Transfer, issued Sep. 26, 2006, to Martinez, and LaCaze (the sole inventor herein) and which is incorporated herein fully by reference, describes an ink jet printer for the printing of indicia on solid non-planar objects such as baseball bats. Multiple bats are held in a horizontal carousel structure and are positioned relative to printheads and then rotated in relation to the printhead which is computer-controlled to apply ink according to a programmed image file.

However, this structure is not suitable for hollow cans or two-piece bottles. What is needed is a programmable ink jet printer that allows for the proofing of two-piece can and bottle designs, without the complexity and cost associated with in-line can and bottle production and printing, as well as allowing for low-speed, high-quality, flexible commercial production with instantaneously variable images on the object.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that combines certain features of various embodiments and still be within the scope contemplated by the appended claims.

Disclosed hereinbelow is an apparatus for non-contact printing of images on generally cylindrical objects, particularly hollow cylindrical objects or hollow partially-cylindrical objects, for example, cans and bottles and including two-piece cans and bottles. It will also be apparent to one skilled in the relevant arts with the benefit of reading this disclosure that solid cylindrical objects and solid partially-cylindrical objects may also be printed by the described apparatuses.

In the one embodiment, each hollow cylindrical object, is hand-loaded and secured by vacuum on a mandrel to prevent slippage, which is part of a carriage assembly that functions to linearly position the can beneath a series of digitally-controlled printheads and rotate the can in front of such printheads while ink is deposited to the can, in order to produce the desired printed design. The ink is also either partially or fully cured immediately after printing by an energy-emitting means positioned directly beneath the can, which is able to function while beneath the printheads or anytime during the functioning of the invention.

The carriage assembly is fixedly mounted to a linear slide actuator, which is in turn fixedly mounted to a mounting frame, whereby the carriage assembly is free to traverse along the linear slide actuator. Also attached to said frame is any number of print tunnels containing—in the described first embodiment—four printheads capable of depositing four individual colors, or coatings, lacquers or overvarnish as known in the present art.

In the preferred operation of the first embodiment, the carriage linearly advances the can in a position within the first print tunnel such that a first portion of the can may be printed if the can is longer than the length of the printhead, as such printheads are currently limited in length. The can is rotated while the computer-controlled printheads deposit ink from supply means located above the print tunnel. Simultaneously the energy-emitting means either partially or completely cures the ink. The carriage then continues to advance the can further such that the entire length of the can is printed by the first print tunnel. The continuous advancement may not be necessary if the printheads are longer than the image desired to be printed on the can. Conversely, the number of times said indexing must occur is variable, given various length cans may need to be printed and/or various length printheads are to be used.

The indexing/rotating/energy emitting sequence is repeated for as many print tunnels as are required to complete the intended printed design on the can. The carriage linearly returns to the load position, blows the printed can off via compressed air, and is then ready for loading the next can. The present invention drawings illustrate two print tunnels with four printheads each, but the number of print tunnels and/or the number of printheads per print tunnel should not be considered a limiting factor.

In an alternative operation of the first embodiment, the carriage assembly continuously linearly advances the can while simultaneously rotating the can as it passes within, and is printed by, each of the print tunnels.

In a second embodiment of the invention, each hollow partially-cylindrical object (or bottle) is hand-loaded and secured at the closed end by vacuum on an object holding assembly and at the open end by an object clamping assembly, which are both part of a carriage assembly that functions to linearly position the bottle beneath a series of digitally-controlled printheads and rotate the bottle in front of such printheads while ink is deposited to the bottle, in order to produce the desired printed design. The ink is also either partially or fully cured immediately after printing by an energy-emitting means positioned directly beneath the bottle, which is able to function while beneath the printheads or anytime during the functioning of the invention.

The carriage assembly is fixedly mounted to a linear slide actuator, which is in turn fixedly mounted to a mounting frame, whereby the carriage assembly is free to traverse along the linear slide actuator. Also attached to said frame is any number of print tunnels containing—as in the described first embodiment—four printheads capable of depositing four individual colors, or coatings, lacquers or overvarnish as known in the present art.

In the preferred operation of this second embodiment—as with the preferred operation of the first embodiment—the carriage linearly advances the bottle in a position within the first print tunnel such that a first portion of the bottle may be printed if the cylindrical portion of the bottle is longer than the length of the printhead, as such printheads are currently limited in length. The bottle is rotated while the computer-controlled printheads deposit ink from supply means located above the print tunnel. Simultaneously the energy-emitting means either partially or completely cures the ink. The carriage then continues to advance the bottle further such that the entire length of the can is printed by the first print tunnel. The continuous advancement may not be necessary if the printheads are longer than the image desired to be printed on the bottle. Conversely, the number of times said indexing must occur is variable, given various length bottles may need to be printed and/or various length printheads are to be used.

As with the first embodiment for the can, in this second embodiment for the bottle the indexing/rotating/energy emitting sequence is repeated for as many print tunnels as are required to complete the intended printed design on the bottle. The carriage linearly returns to the load position, the object clamping assembly releases the open end of the bottle and air is applied to the object holding assembly to release the bottle; the next bottle is then ready for loading. The present invention drawings illustrate two print tunnels with four printheads each, but the number of print tunnels and/or the number of printheads per print tunnel should not be considered a limiting factor.

In an alternative operation of the second embodiment for bottles—as with the first embodiment for cans—the carriage assembly continuously linearly advances the bottle while simultaneously rotating the bottle as it passes within, and is printed by, each of the print tunnels.

In a third embodiment of the invention, each hollow cylindrical object (or can) is hand-loaded and secured by vacuum on a mandrel to prevent slippage, which is part of a carriage assembly that functions to linearly position the can beneath a series of digitally-controlled printheads and rotate the can in front of such printheads while ink is deposited to the can, in order to produce the desired printed design. The ink is also either partially or fully cured immediately after printing by an energy-emitting means positioned directly beneath the can, which is able to function while beneath the printheads or anytime during the functioning of the invention.

The carriage assembly is fixedly mounted to a linear slide actuator, which is in turn fixedly mounted to a mounting frame, whereby the carriage assembly is free to traverse along the linear slide actuator. Also attached to the frame is any number of print stations, each containing a printhead capable of depositing ink, coatings, lacquers or over-varnish as known in the present art.

In the preferred operation of the third embodiment, the carriage assembly continuously linearly advances the can while simultaneously rotating the can as it passes beneath, and is printed by, each of the print stations.

In an alternative operation of the third embodiment, the carriage linearly advances the can in a position beneath the first print station such that a first portion of the can may be printed if the can is longer than the length of the printhead, as such printheads are currently limited in length. The can is rotated while the computer-controlled printhead deposits ink from supply means located above the print station. Simultaneously the energy-emitting means either partially or completely cures the ink. The carriage then continues to advance the can further such that the entire length of the can is printed by the first print station. The continuous advancement may not be necessary if the printheads are longer than the image desired to be printed on the can. Conversely, the number of times said indexing must occur is variable, given various length cans may need to printed and/or various length printheads are to be used.

The indexing/rotating/energy emitting sequence is repeated for as many print stations as are required to complete the intended printed design on the can. The carriage linearly returns to the load position, blows the printed can off via compressed air, and is then ready for loading the next can. The present invention drawings illustrate four print stations, but should not be considered a limiting factor.

In a fourth embodiment, each hollow partially-cylindrical object (or bottle) is hand-loaded and secured at the closed end by vacuum on an object holding assembly and at the open end by an object clamping assembly, which are both part of a carriage assembly that functions to linearly position the bottle beneath a series of digitally-controlled printheads and rotate the bottle in front of such printheads while ink is deposited to the bottle, in order to produce the desired printed design. The ink is also either partially or fully cured immediately after printing by an energy-emitting means positioned directly beneath the bottle, which is able to function while beneath the printheads or anytime during the functioning of the invention.

The carriage assembly is fixedly mounted to a linear slide actuator, which is in turn fixedly mounted to a mounting frame, whereby the carriage assembly is free to traverse along the linear slide actuator. Also attached to the frame is any number of print stations, each containing a printhead capable of depositing ink, coatings, lacquers or overvarnish as known in the present art.

In the preferred operation of the fourth embodiment, the carriage assembly continuously linearly advances the bottle while simultaneously rotating the bottle as it passes beneath, and is printed by, each of the print stations.

In an alternative operation of the fourth embodiment, the carriage linearly advances the can in a position beneath the first print station such that a first portion of the bottle may be printed if the bottle is longer than the length of the printhead, as such printheads are currently limited in length. The bottle is rotated while the computer-controlled printhead deposits ink from supply means located above the print station. Simultaneously the energy-emitting means either partially or completely cures the ink. The carriage then continues to advance the can further such that the entire length of the bottle is printed by the first print station. The continuous advancement may not be necessary if the printheads are longer than the image desired to be printed on the bottle. Conversely, the number of times said indexing must occur is variable, given various length bottles may need to be printed and/or various length printheads are to be used.

The indexing/rotating/energy emitting sequence is repeated for as many print stations as are required to complete the intended printed design on the bottle. The carriage linearly returns to the load position, the object clamping assembly releases the open end of the bottle and air is applied to the object holding assembly to release the bottle; the next bottle is then ready for loading. The present invention drawings of the second fourth illustrate four print stations, but should not be considered a limiting factor achieves or optimizes one advantage or group of advantages as taught herein without necessarily achieving other advantages as may be taught or suggested herein.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements.

DETAILED DESCRIPTION

The various embodiments of the present invention and their advantages are best understood by referring to FIGS. 1 through 35 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

Figure 1:
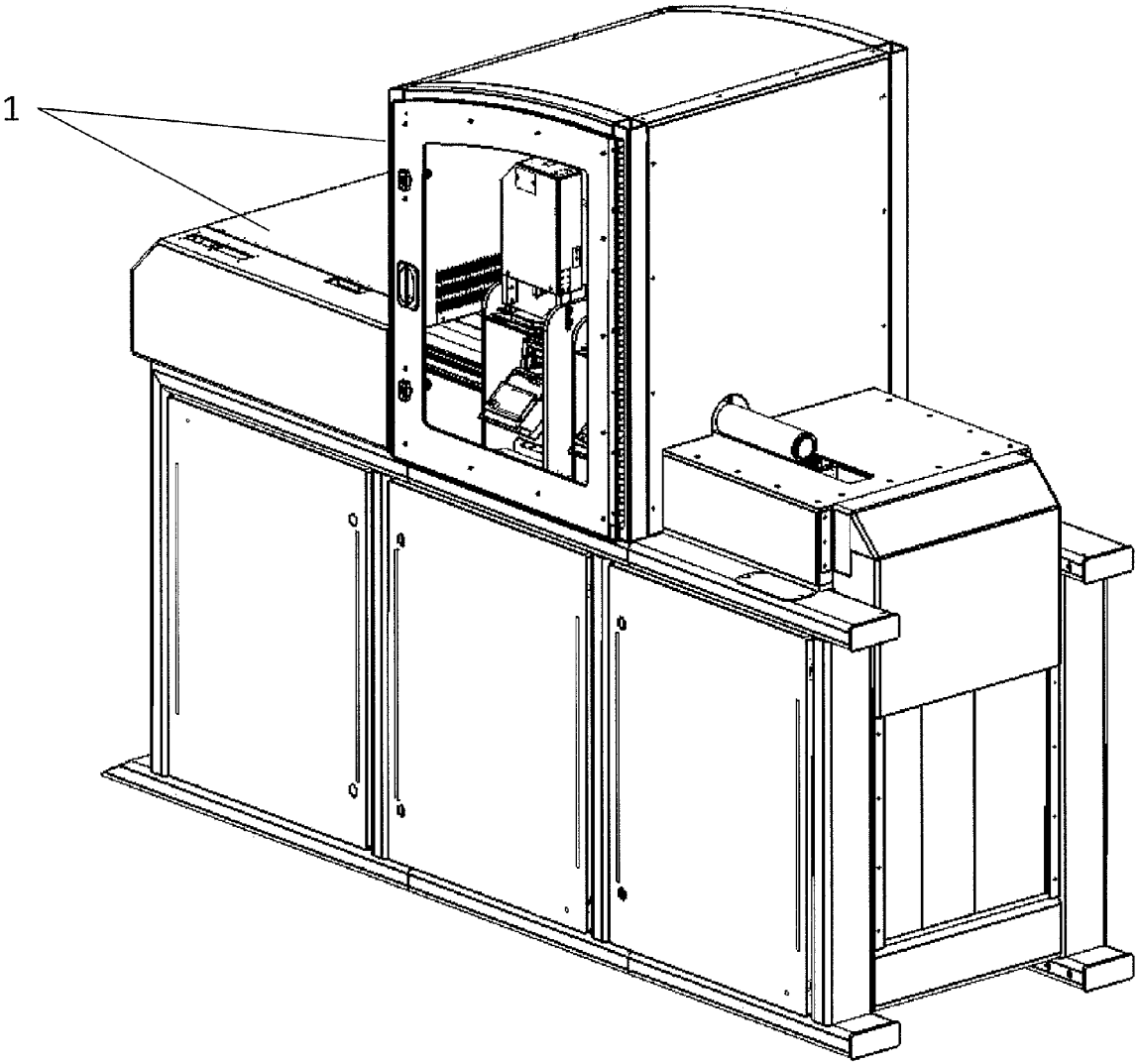
FIG. 1 shows an exemplary digital printing apparatus for decorating hollow cylindrical objects.
Figure 2:
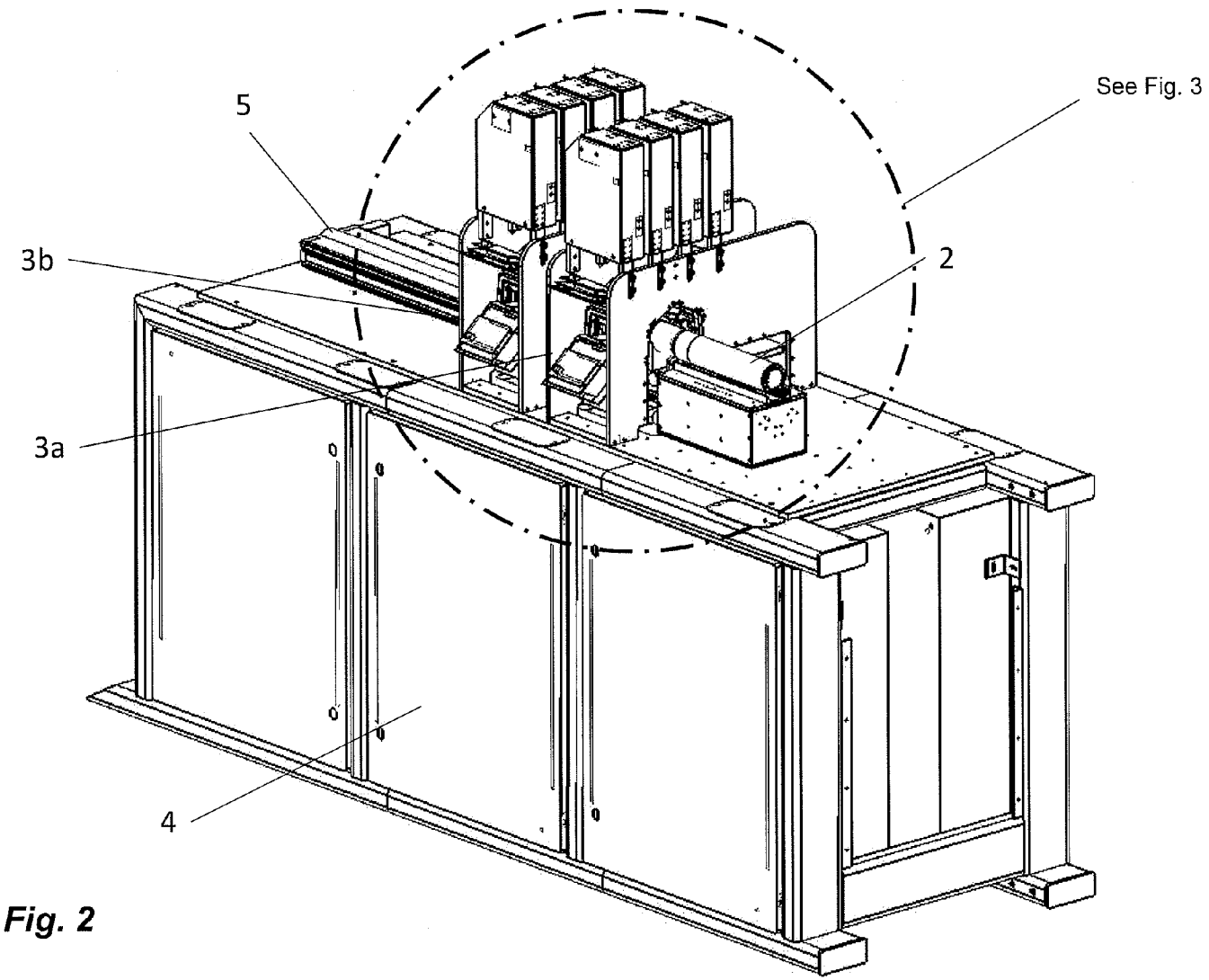
FIG. 2 depicts the apparatus with top covers removed for clarity.

Referring first to FIG. 1, an exemplary digital printing apparatus for decorating cylindrical objects, for example, cans is illustrated with top covers 1 in place. FIG. 2 depicts the invention with top covers 1 removed for clarity. The apparatus comprises four main, interconnected components: carriage assembly 2, print tunnels 3*a*, 3*b*, support frame 4, and linear slide actuator 5. The linear slide actuator 5 and print tunnels 3*a*, 3*b* are both connected directly to the support frame 4. The carriage assembly 2 is in turn mounted directly to the linear slide actuator 5.

Figure 3:
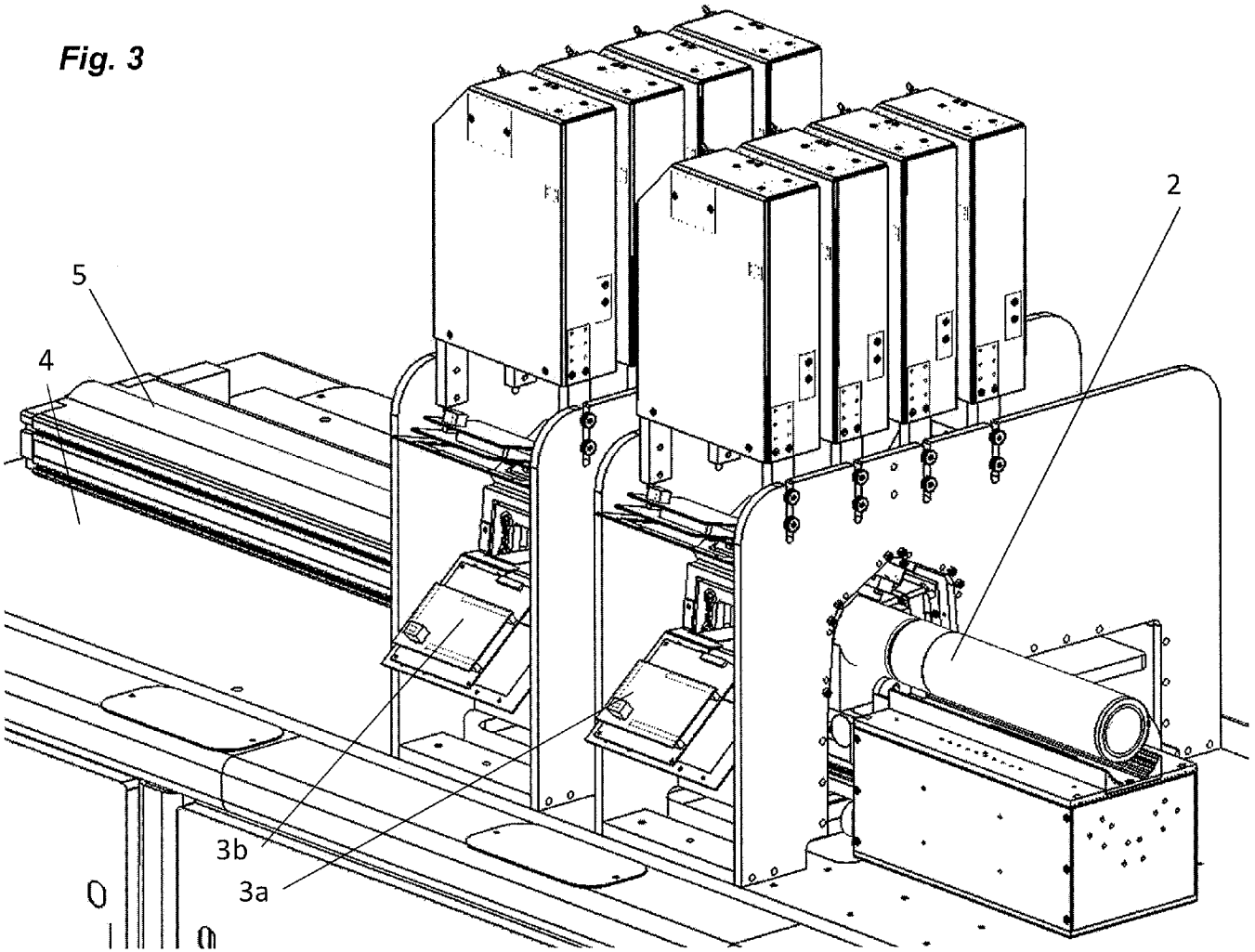
FIG. 3 is a close-up view of the major components printing apparatus.
Figure 4:
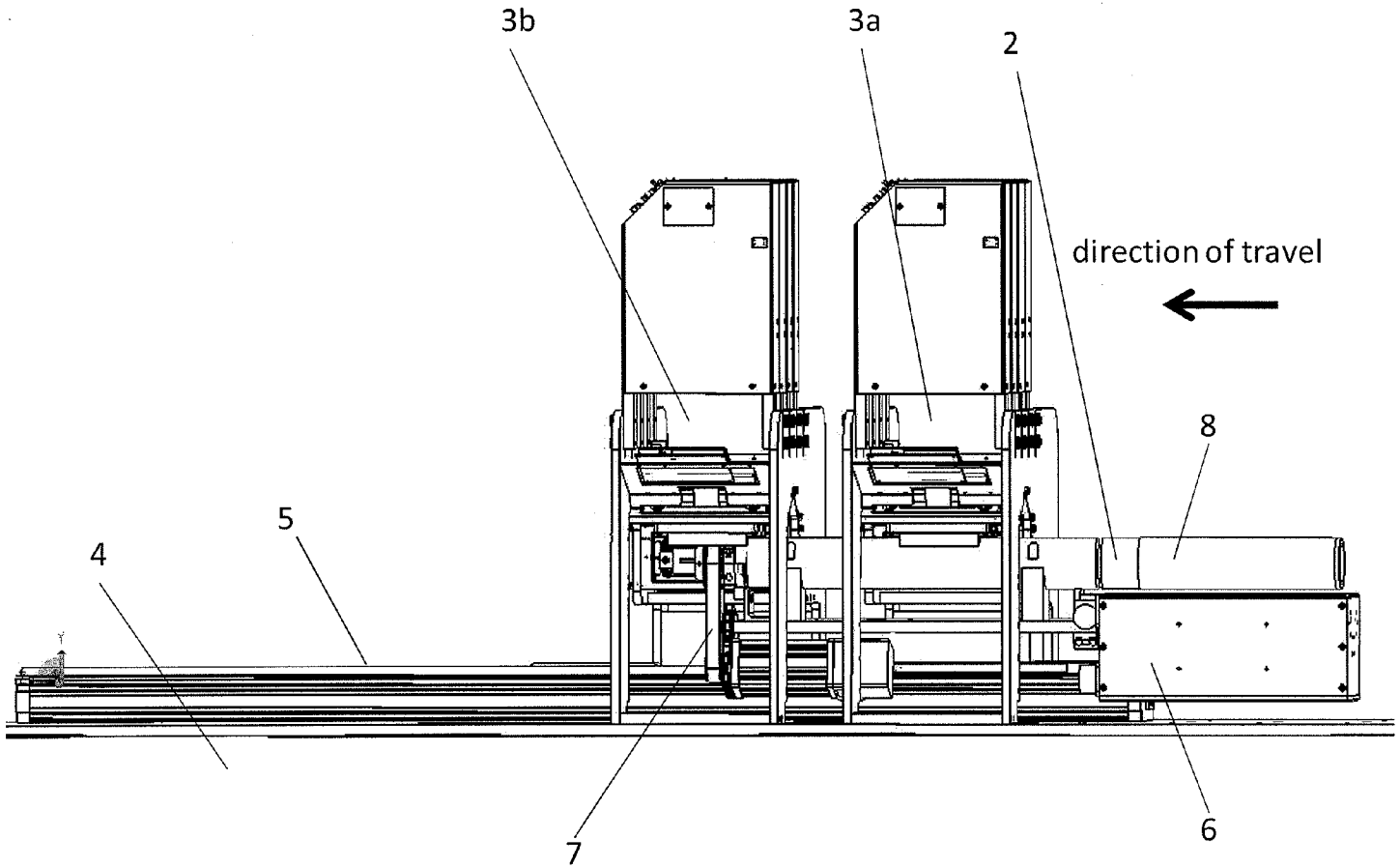
FIG. 4 is a side elevation of the printing apparatus.

FIG. 3 is a close-up view showing the relationship between the carriage assembly 2, print tunnels 3*a*, 3*b* and mounting frame 4, as well as the linear slide actuator 5 on which the carriage assembly 2 linearly traverses. FIG. 4 is a side elevation of the apparatus showing the energy curing assembly 6, rotational drive assembly 7, and hollow cylindrical object 8 to be printed. The linear slide actuator 5 transports the carriage assembly 2 into the print tunnels 3*a*, 3*b* while the rotational drive assembly 7 rotates the carriage assembly 2, and thus, the hollow cylindrical object to be printed within the print tunnels 3*a*, 3*b*.

Figure 5:
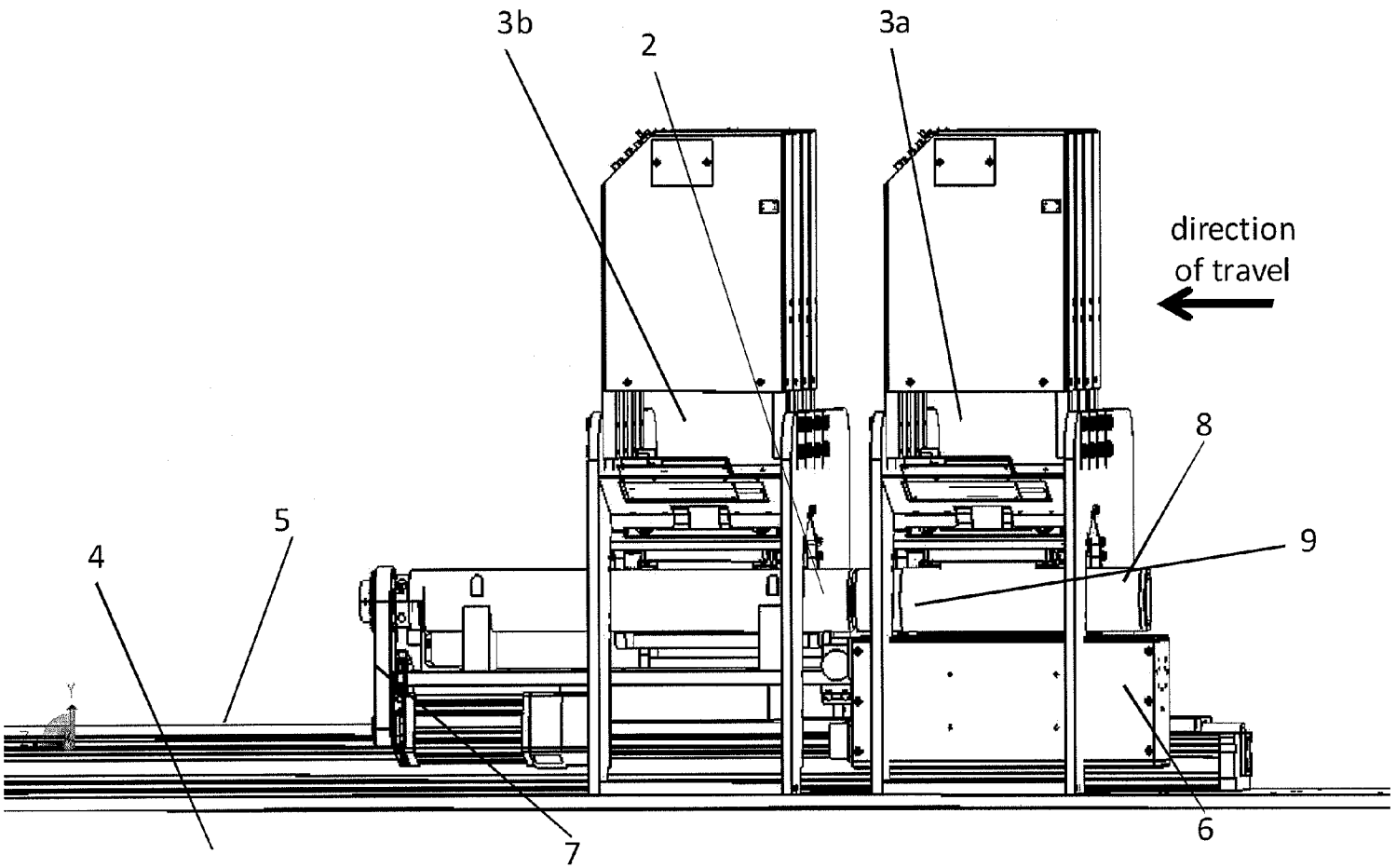
FIG. 5 depicts the carriage assembly linearly advanced in a first position.

The carriage assembly 2, includes a mandrel assembly 9 mounted to be aligned along the direction of travel, dimensioned to internal support a hollow cylindrical object. The mandrel assembly 9 is coupled to rotational drive assembly 7. In this embodiment, the carriage assembly is shown to also include the energy curing assembly 6 mounted to the carriage directly underneath the mandrel assembly 9 such that curing energy (discussed below) is radiated onto the mandrel assembly and specifically onto the cylindrical object mounted thereon. FIG. 5 depicts the carriage assembly 2 linearly advanced by the linear slide actuator 5 such that a portion of the hollow cylindrical object 8 to be printed may be printed a length not greater than that of the printheads (discussed in greater detail below) while properly positioned within the first of the print tunnels 3*a*. During printing, the carriage assembly 2 remains linearly stationary while the rotational drive assembly 7 rotates the mandrel assembly 9, onto which the hollow cylindrical object 8 to be printed is mounted. The number of rotations is dependent upon the desired resolution in dots per inch of the image to be printed. Meanwhile, the energy curing assembly 6 applies energy to the hollow cylindrical object 8 to be printed after printing to either partially cure the print to prevent running of the ink prior to further printing or to completely cure the ink as a finished product if appropriate and desired.

Figure 6:
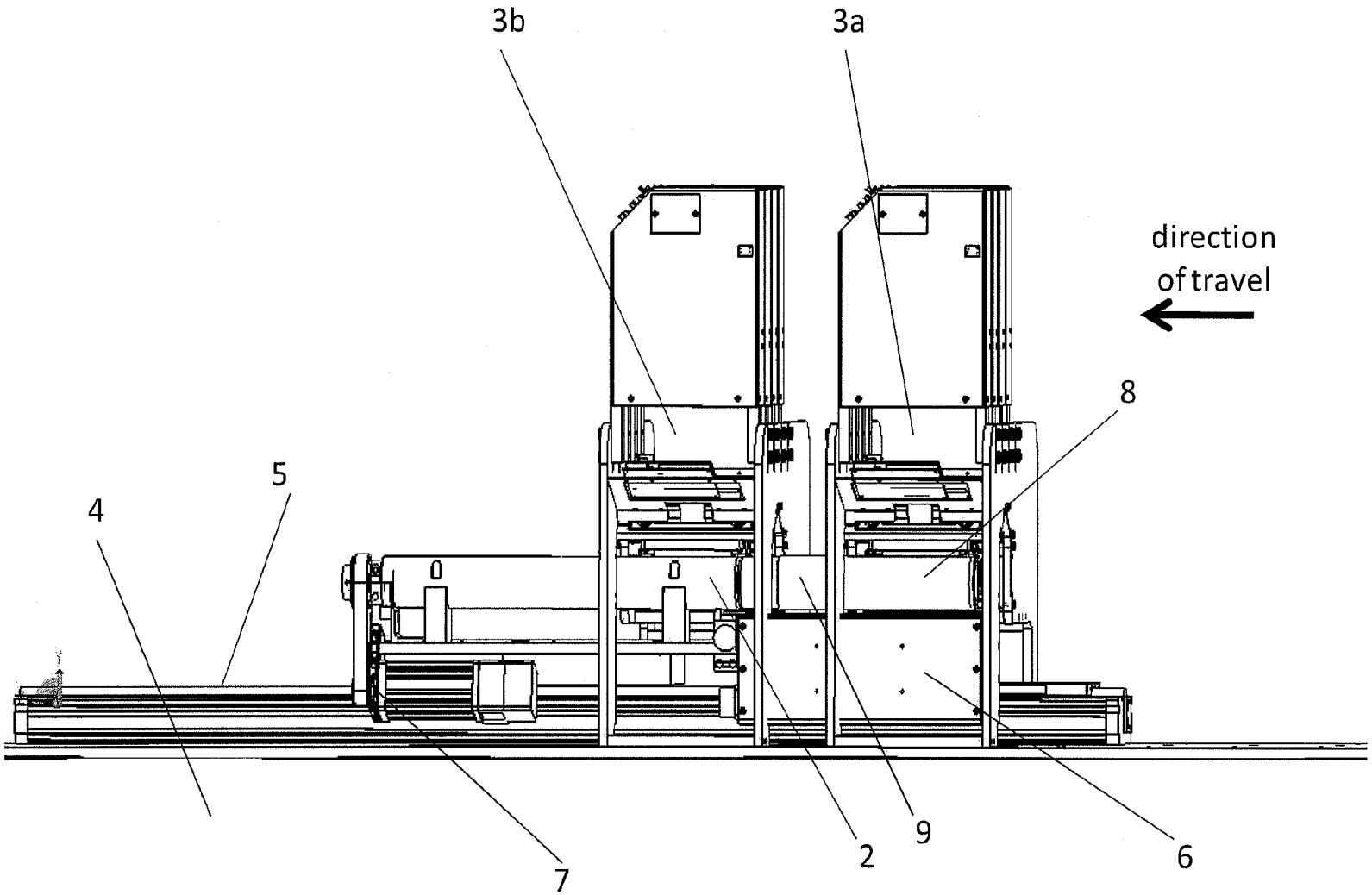
FIG. 6 depicts the carriage assembly further linearly advanced in a second position.

FIG. 6 illustrates the carriage assembly 2 further linearly advanced by the linear slide actuator 5 sufficiently to complete the printing of the hollow cylindrical object 8 to be printed in the first of the print tunnels 3*a*. The number of times necessary for the carriage assembly 2 to be linearly indexed by the linear slide actuator 5 is dependent upon the length of the hollow cylindrical object 8 to be printed compared to the available length of the printheads (discussed in greater detail below).

Figure 7:
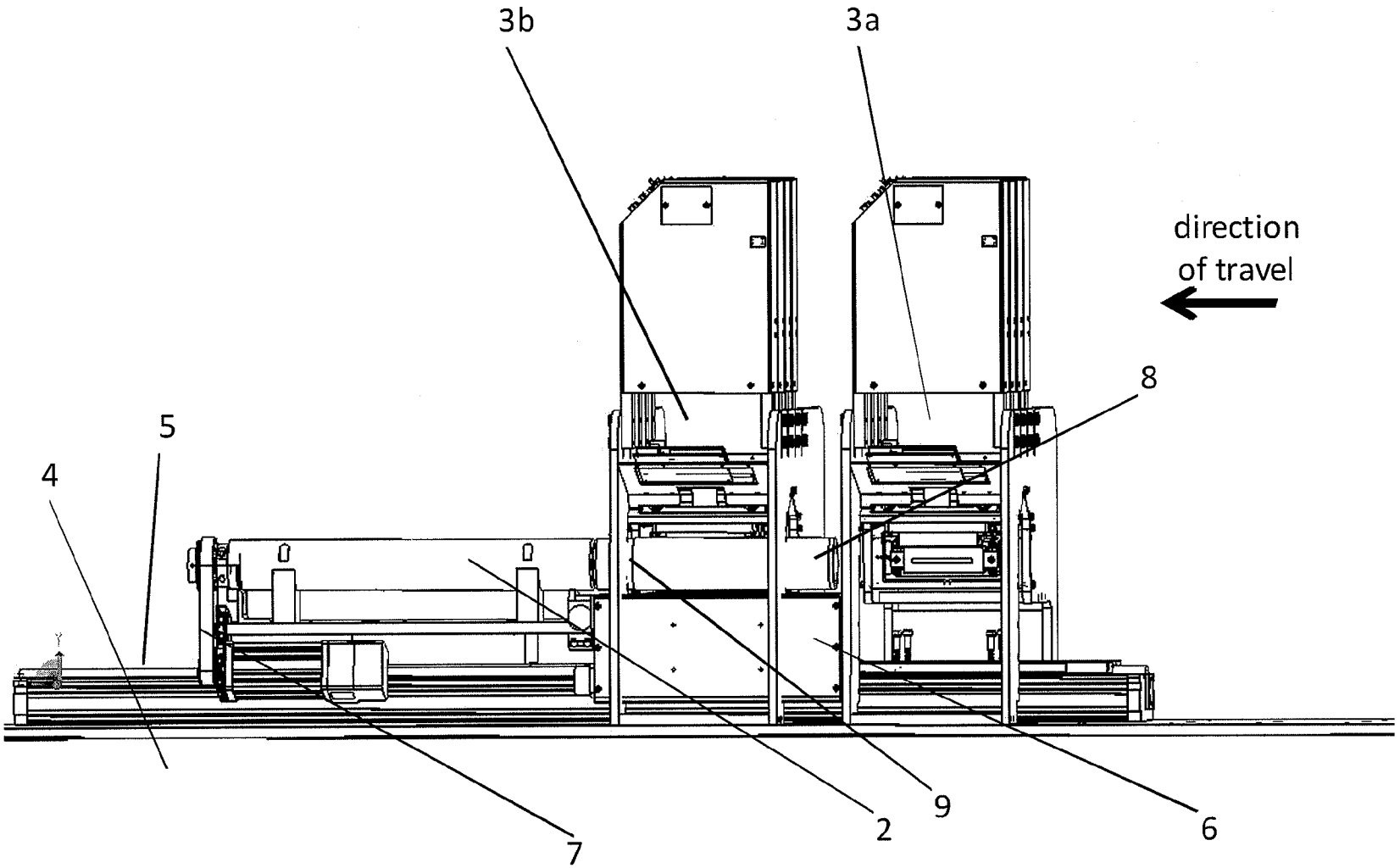
FIG. 7 depicts the carriage assembly further linearly advanced in a third position.

FIG. 7 shows the carriage assembly 2 linearly advanced by the linear slide actuator 5 sufficiently to begin printing the hollow cylindrical object 8 to be printed within the second of the print tunnels 3*b*. The number of print tunnels 3*a*, 3*b* shown here is two, but can be as many as dictated by the number of colors to be printed, as the number of colors in the current embodiment is limited to four per print tunnel 3*a*, 3*b*. Other media besides ink may be printed on the hollow cylindrical object 8 to be printed and may include, but is not limited to, overcoat varnish, size coating, base coating, and any applicable protective or decorative fluid used to enhance the appearance of, or afford protection of, the hollow cylindrical object 8 to be printed, and/or to improve adhesion of the ink to be used in its printing.

Figure 8:
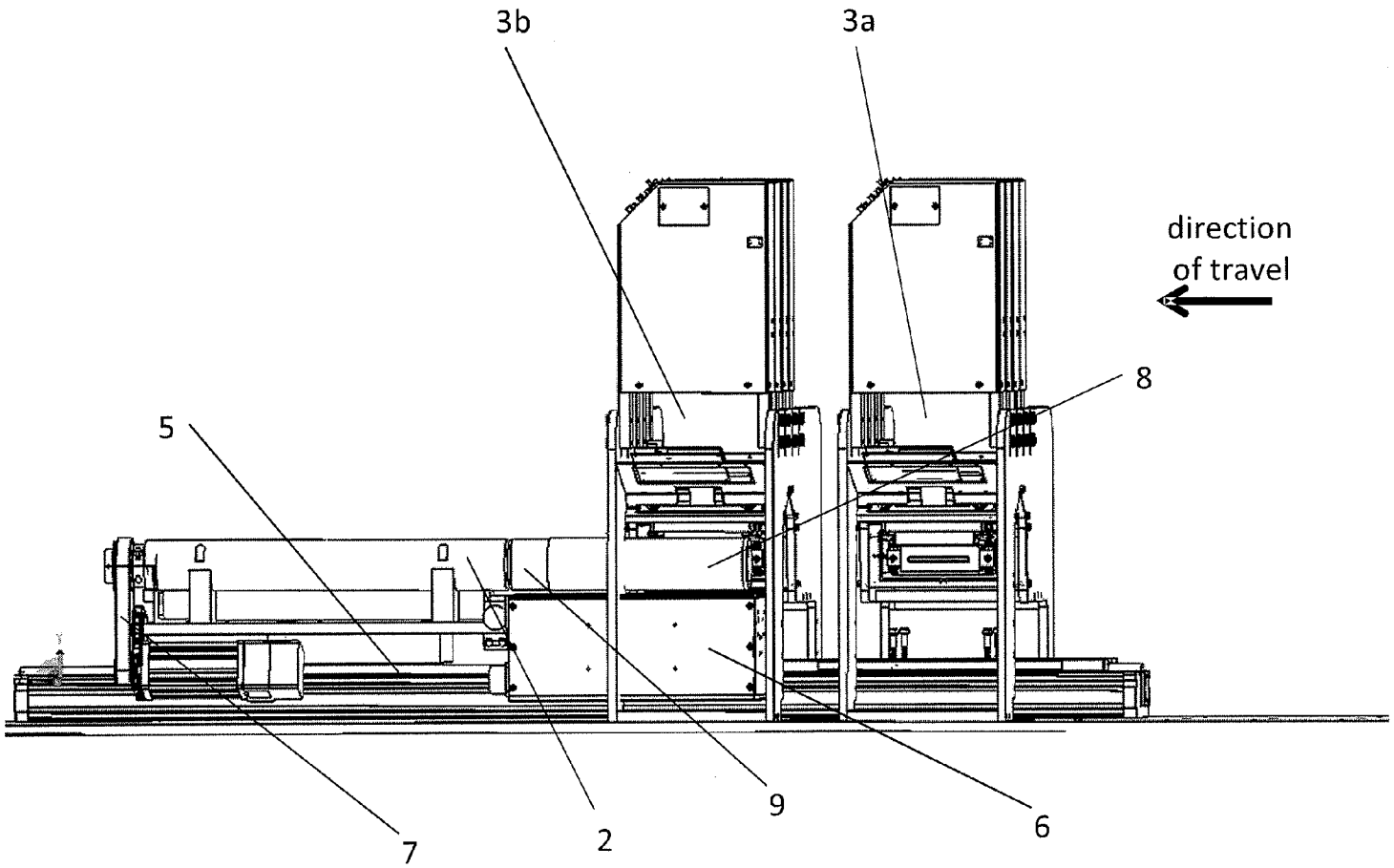
FIG. 8 depicts the carriage assembly further linearly advanced in a fourth position.

FIG. 8 illustrates the carriage assembly 2 linearly advanced by the linear slide actuator 5 sufficiently to complete the printing of the hollow cylindrical object 8 in the second of the print tunnels 3*b*. The number of times necessary for the carriage assembly 2 to be linearly indexed by the linear slide actuator 5 is dependent upon the length of the hollow cylindrical object 8 to be printed compared to the available length of the printheads (discussed in greater detail below).

Figure 9:
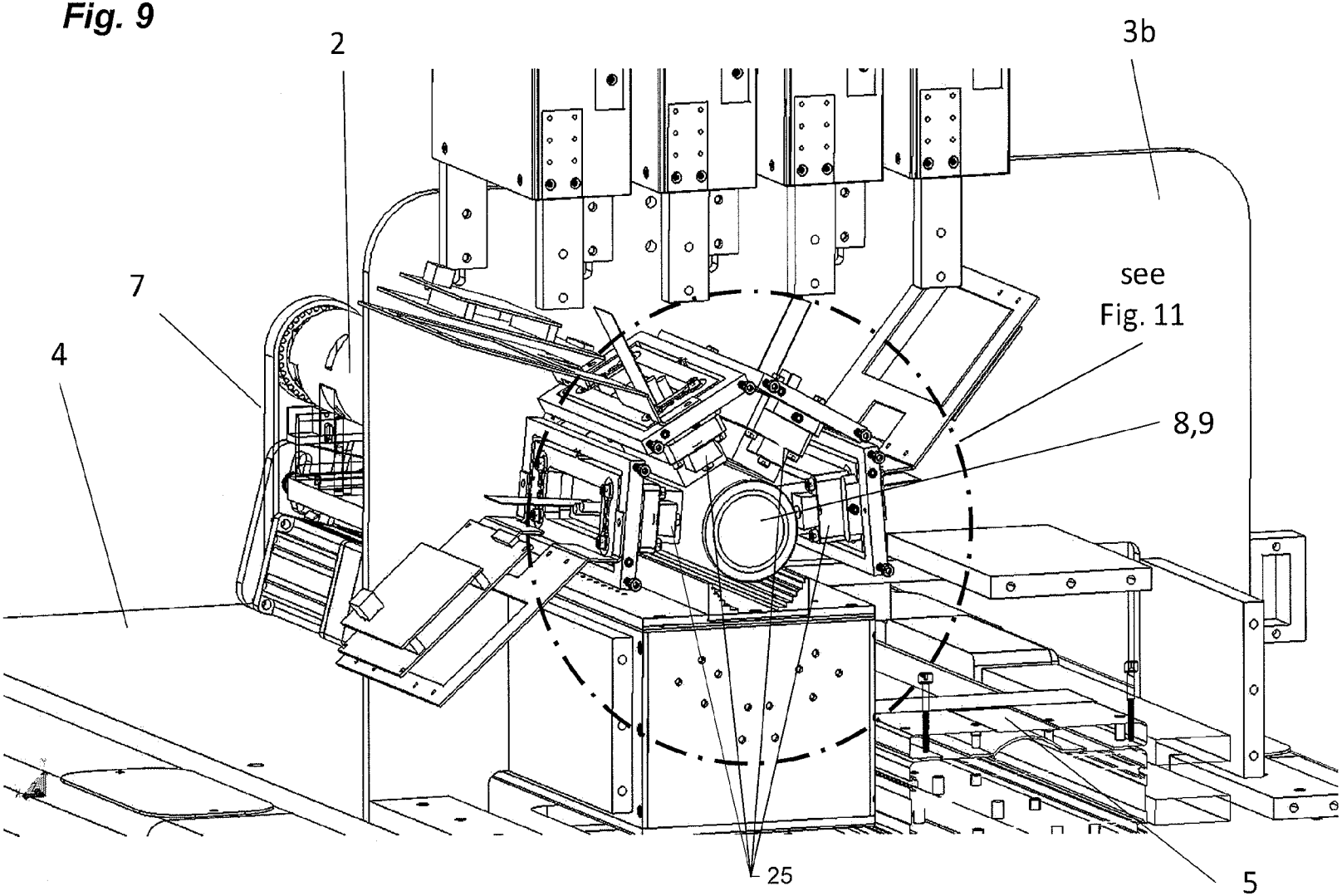
FIG. 9 shows the interconnection of the major components of the invention.

In FIG. 9 is a perspective view of an exemplary print tunnel 3*b* illustrating the interconnection of the major components, namely the linear slide actuator 5, the carriage assembly 2 connected to the linear slide actuator 5 and the print tunnel 3*b*. It will be noted that the print tunnel is generally formed by the arch created by the way the printheads 25 are mounted through which ink (or other fluid) is deposited upon the desired object.

Figure 10:
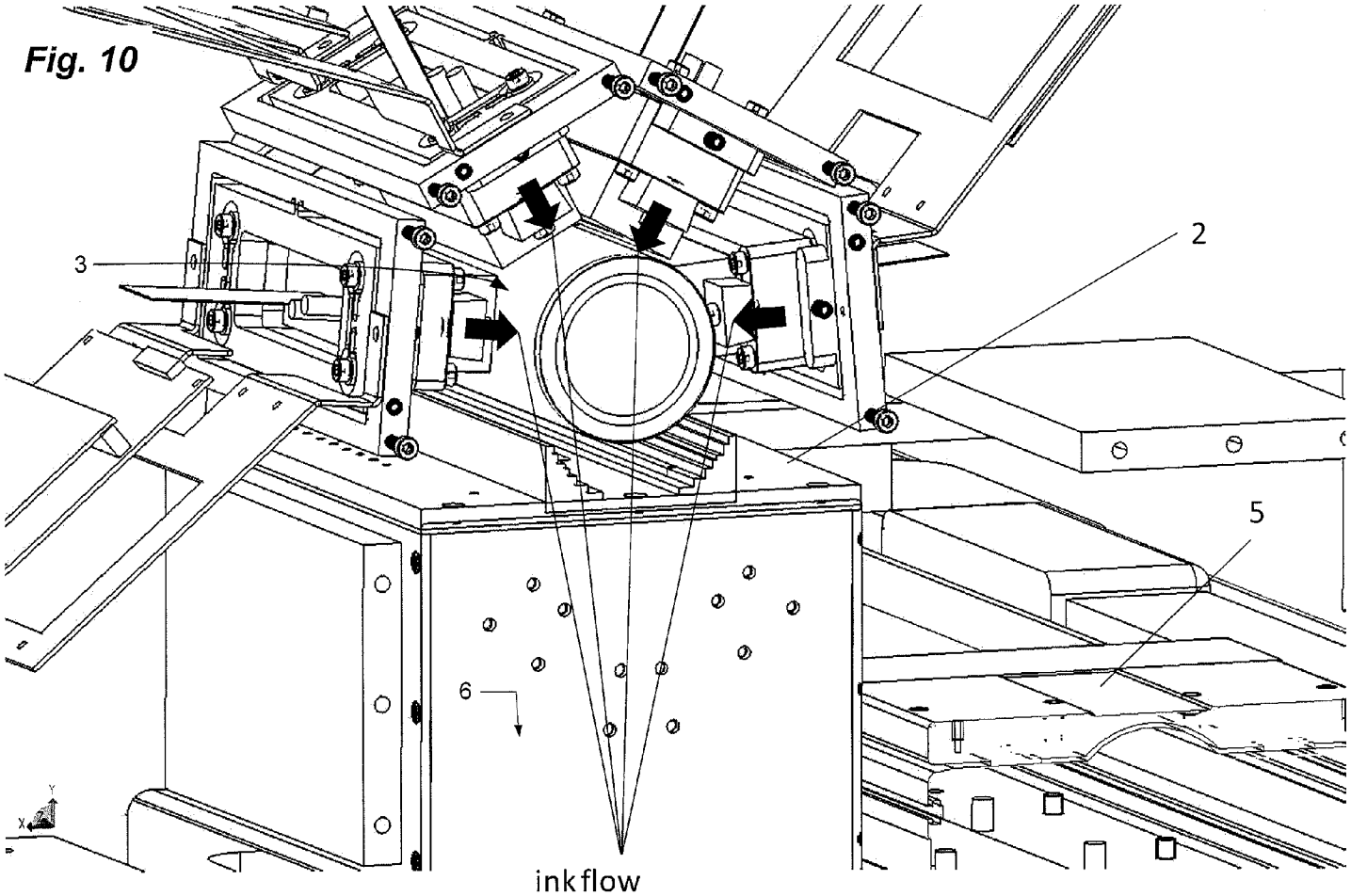
FIG. 10 is a close-up view of the relationship between the major components.
Figure 11:
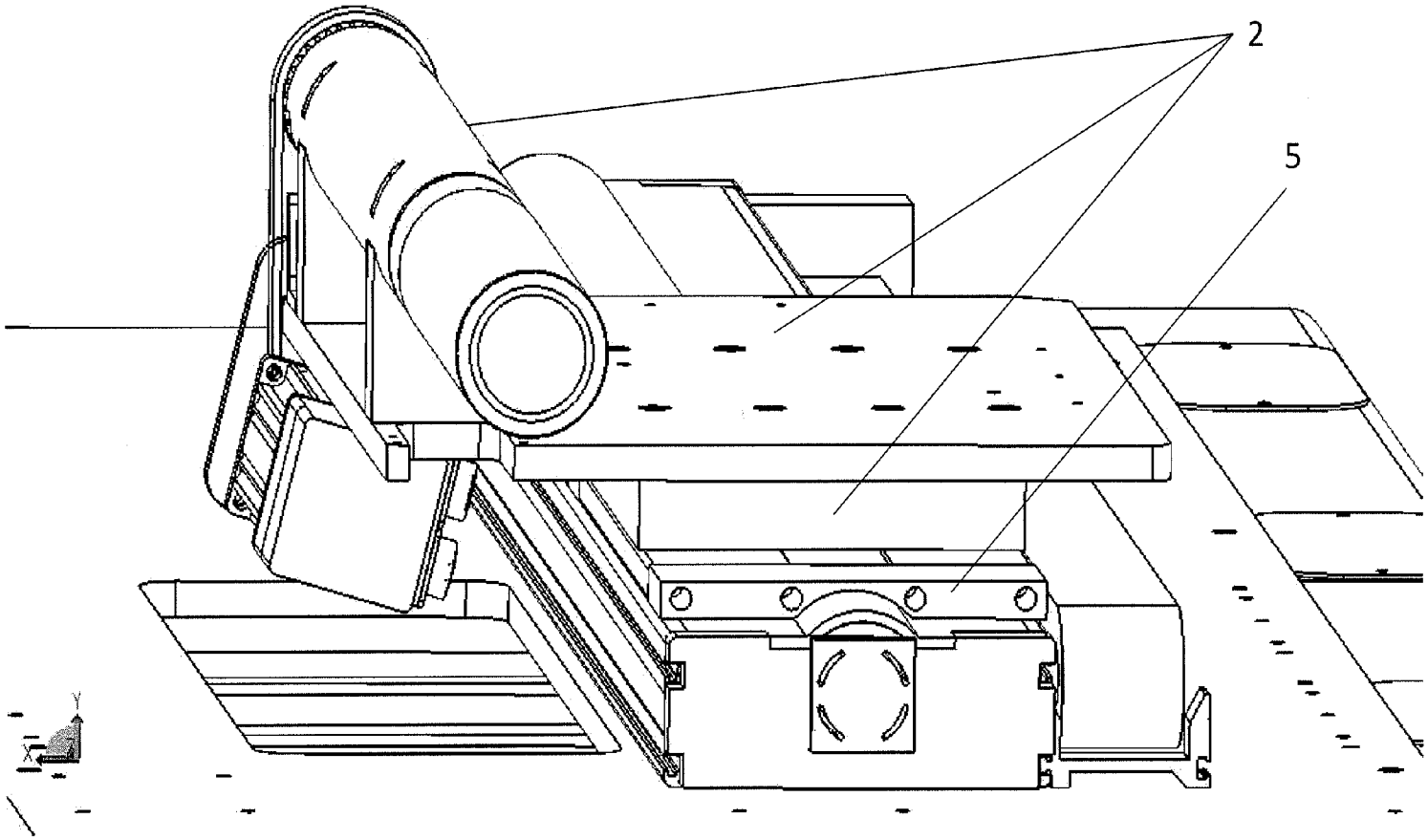
FIG. 11 clarifies the interconnections between the major components.

FIG. 10 also shows the relationship between the major components, namely the linear slide actuator 5, carriage assembly 2, and print tunnel 3 and energy curing assembly 6. FIG. 11 further clarifies the interconnection between the linear slide actuator 5 and carriage assembly 2, with the print tunnels 3*a*, 3*b* and energy curing assembly 6 removed for clarity.

Figure 12:
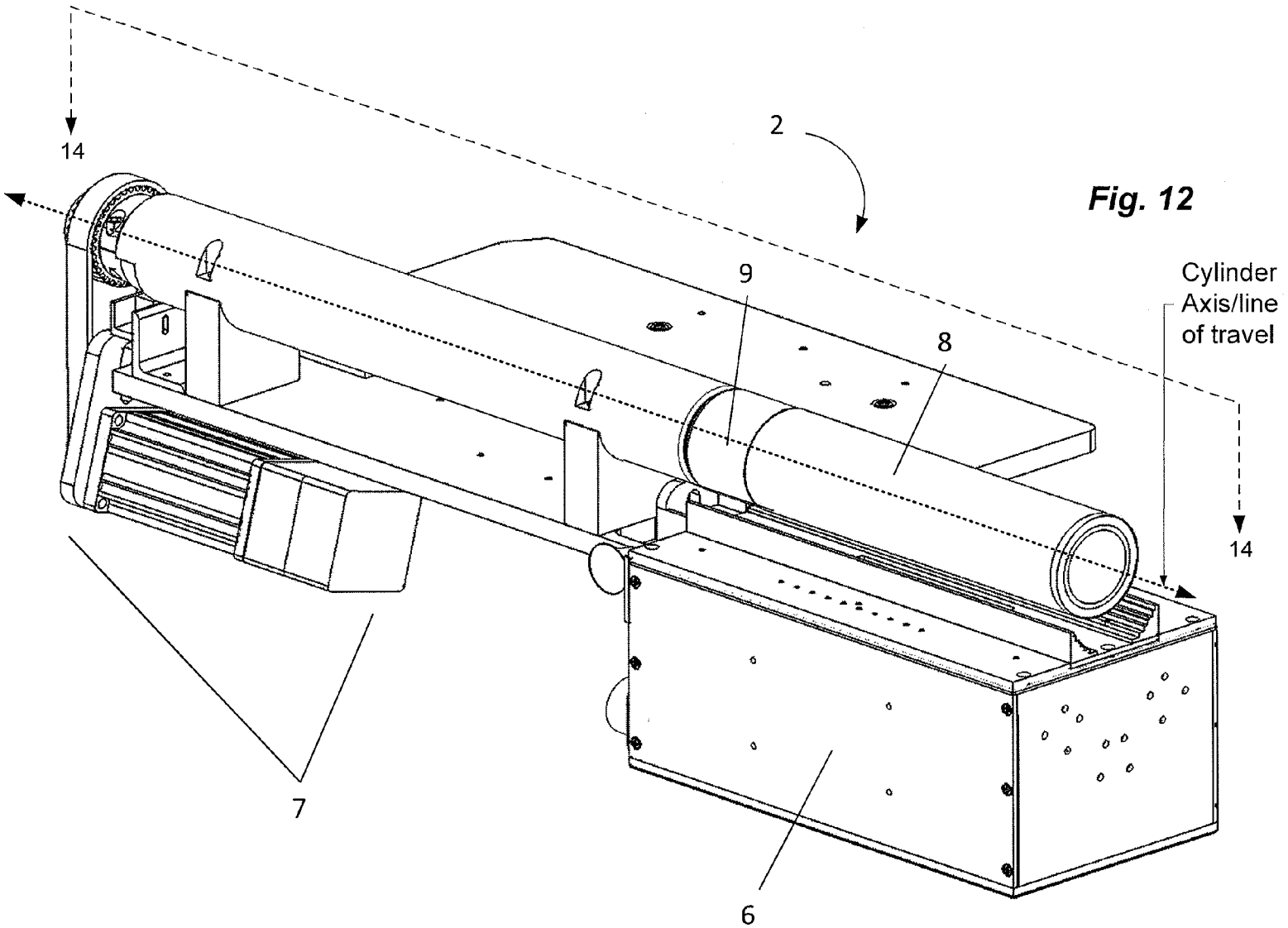
FIG. 12 shows the components of the carriage assembly.
Figure 13:
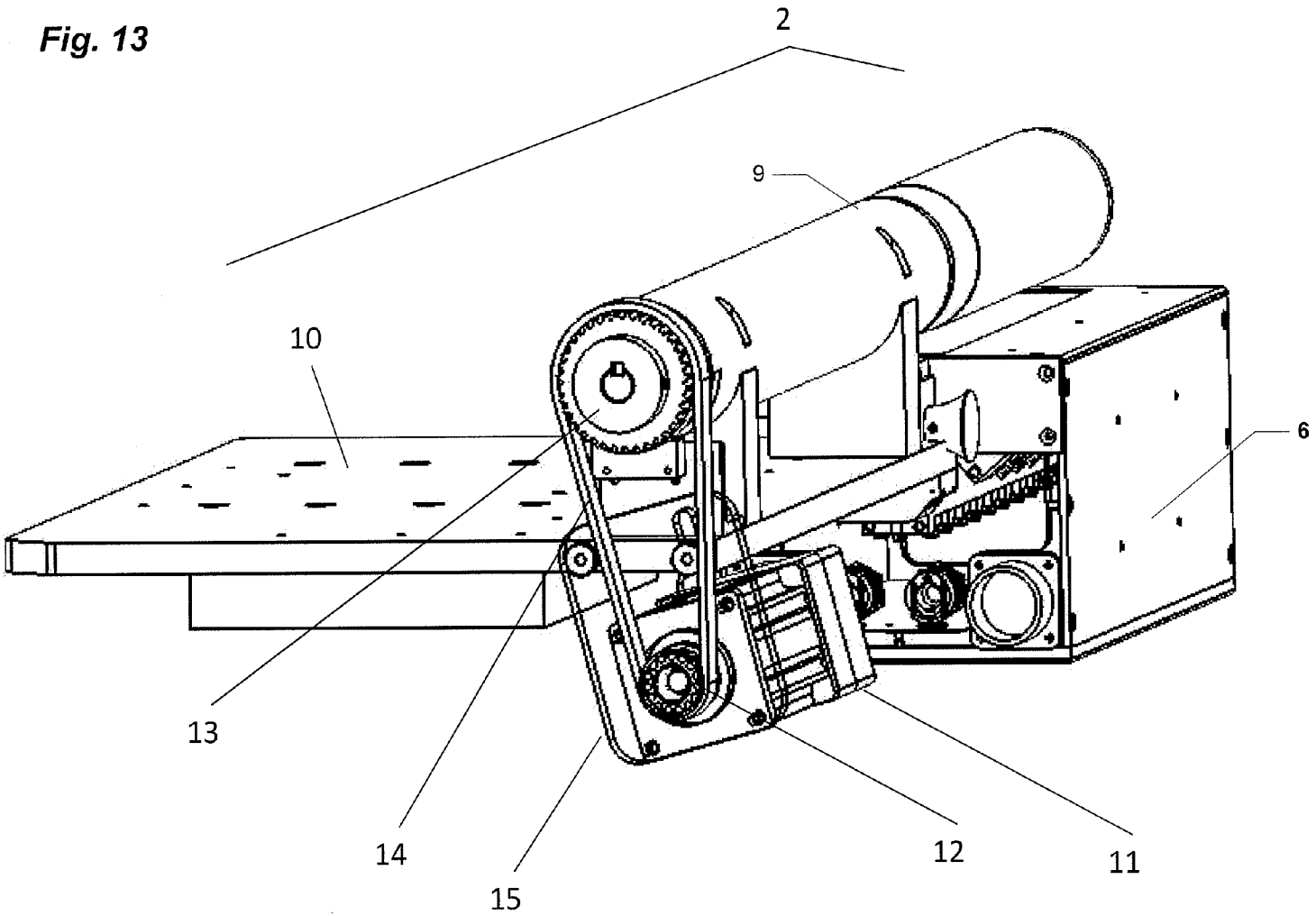
FIG. 13 is a view of the rotary drive end of the carriage assembly.

FIG. 12 shows all the components of the carriage assembly 2, including the rotational drive assembly 7, energy curing assembly 6, and mandrel assembly 9 rotationally coupled to the rotational drive assembly 7, and showing a hollow cylindrical object 8 to be printed mounted thereon. FIG. 13 is a view of the rotary drive end of the carriage assembly 2, namely the carriage mounting plate 10, that supports the mounting of the rotational drive motor 11, the mandrel assembly 9 and the energy curing assembly 6 as shown. A drive pulley 12 is coupled to the motor 11 and is engaged to driven pulley 13 by a drive belt 14. It can be seen that the motor may be mounted to an optional rotational drive mounting plate 15. The dashed reference line also indicates that the object 8 is held to be axially aligned with the mandrel assembly 9, and such axis is aligned with the line of travel.

Figure 14:
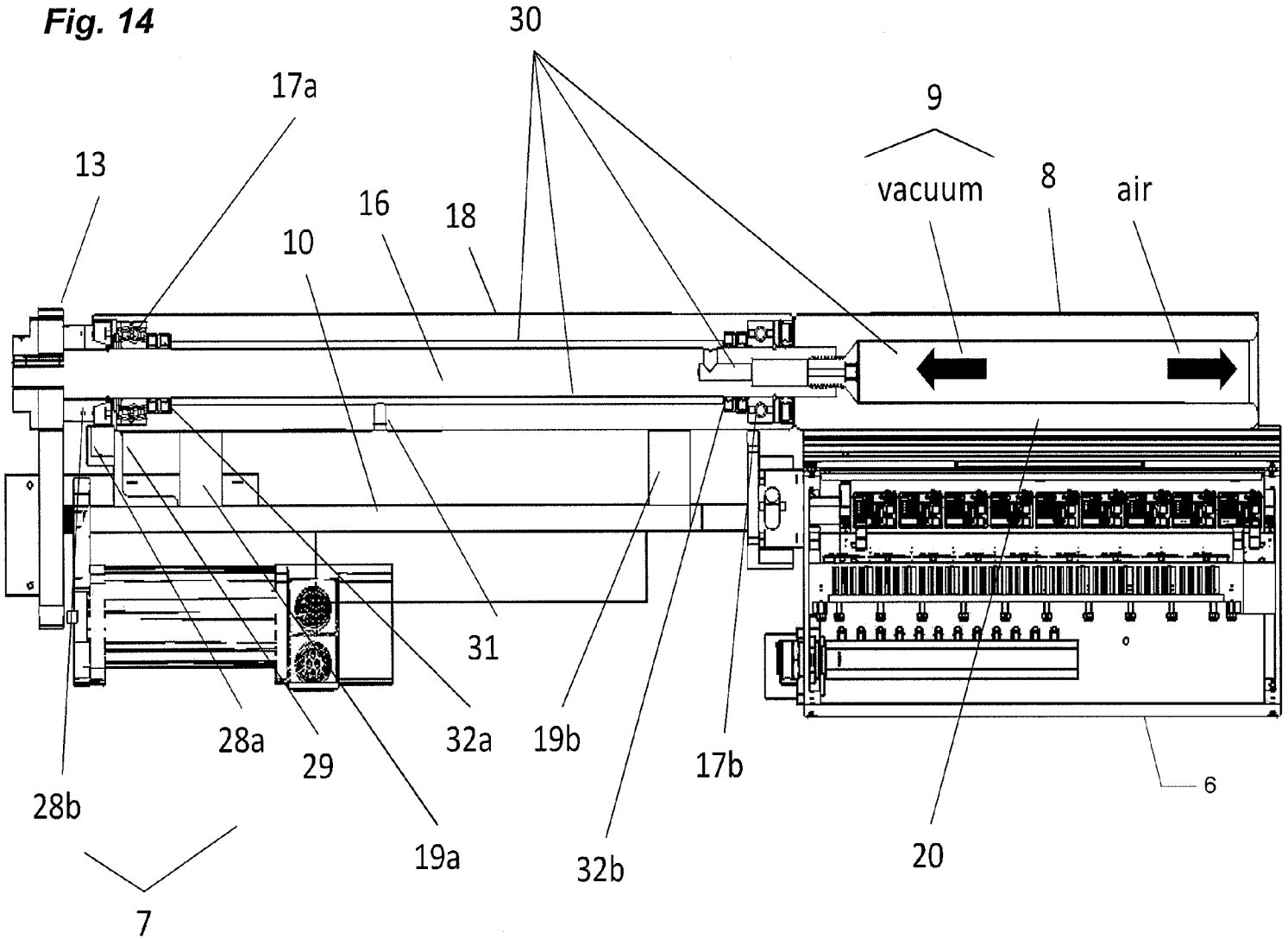
FIG. 14 is a cross-section through the carriage assembly.

FIG. 14 is a cross-section through the carriage assembly 2 showing the detail of the mandrel assembly 9 and its interconnection to the driven pulley 13 of the rotational drive assembly 7 via a drive shaft 16. The drive shaft 16 is mounted via bearings 17*a*, 17*b*, which are mounted within a support tube 18, which is in turn mounted to the carriage mounting plate 10 via support blocks 19*a*, 19*b*. The mandrel 20 is connected to the drive shaft 16 and supports the hollow cylindrical object 8 to be printed. The mandrel 20, drive shaft 16, and support tube 18 are constructed and assembled in such a manner as to create a vacuum/air chamber 30 having an opening toward the free end of the mandrel 20 where the object 8 is positioned with an external vacuum/air connection 31 in the sidewall of the support tube 18. Upon loading the hollow cylindrical object 8 on the mandrel 20, a vacuum is applied via the vacuum/air connection 31, creating a vacuum within the vacuum/air chamber 30 that prevents the hollow cylindrical object 8 from axially or circumferentially slipping on the mandrel 20 so that the precision of ink deposition to the hollow cylindrical object 8 is maximized. The air/vacuum chamber 30 is isolated from the atmosphere via seals 32*a*, 32*b*. A first rotational position sensor 28*a* is attached to the carriage mounting plate 10 via a sensor mount 29. A second rotational position sensor 28*b* is directly attached to the drive shaft 16; the first and second rotational position sensors 28*a*, 28*b* are used to control the precise circumferential deposition of ink to the hollow cylindrical object 8. The vacuum, or at least a low pressure sufficient to draw the cylindrical object against the mandrel, may be created using a conventional air pump coupled to the vacuum/air connection, configured to be selectively reversible. When the cylindrical object 8 has been processed by the apparatus, the pump may be selectively reversed to inject air into the chamber 30, assisting to disengage the object 8 from the mandrel 20.

Figure 15:
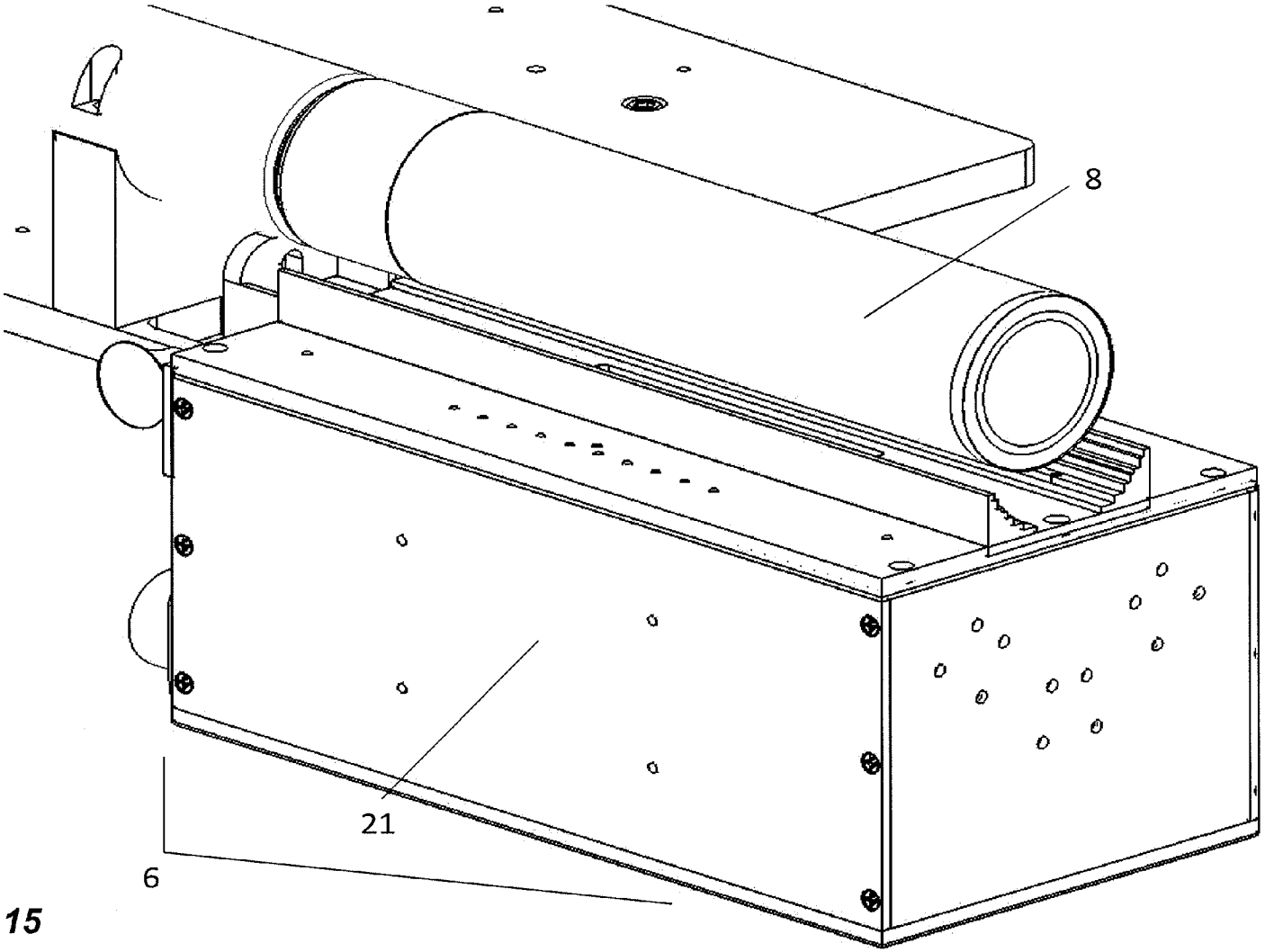
FIG. 15 shows the relationship of the energy curing assembly to the hollow cylindrical object to be printed.
Figure 16:
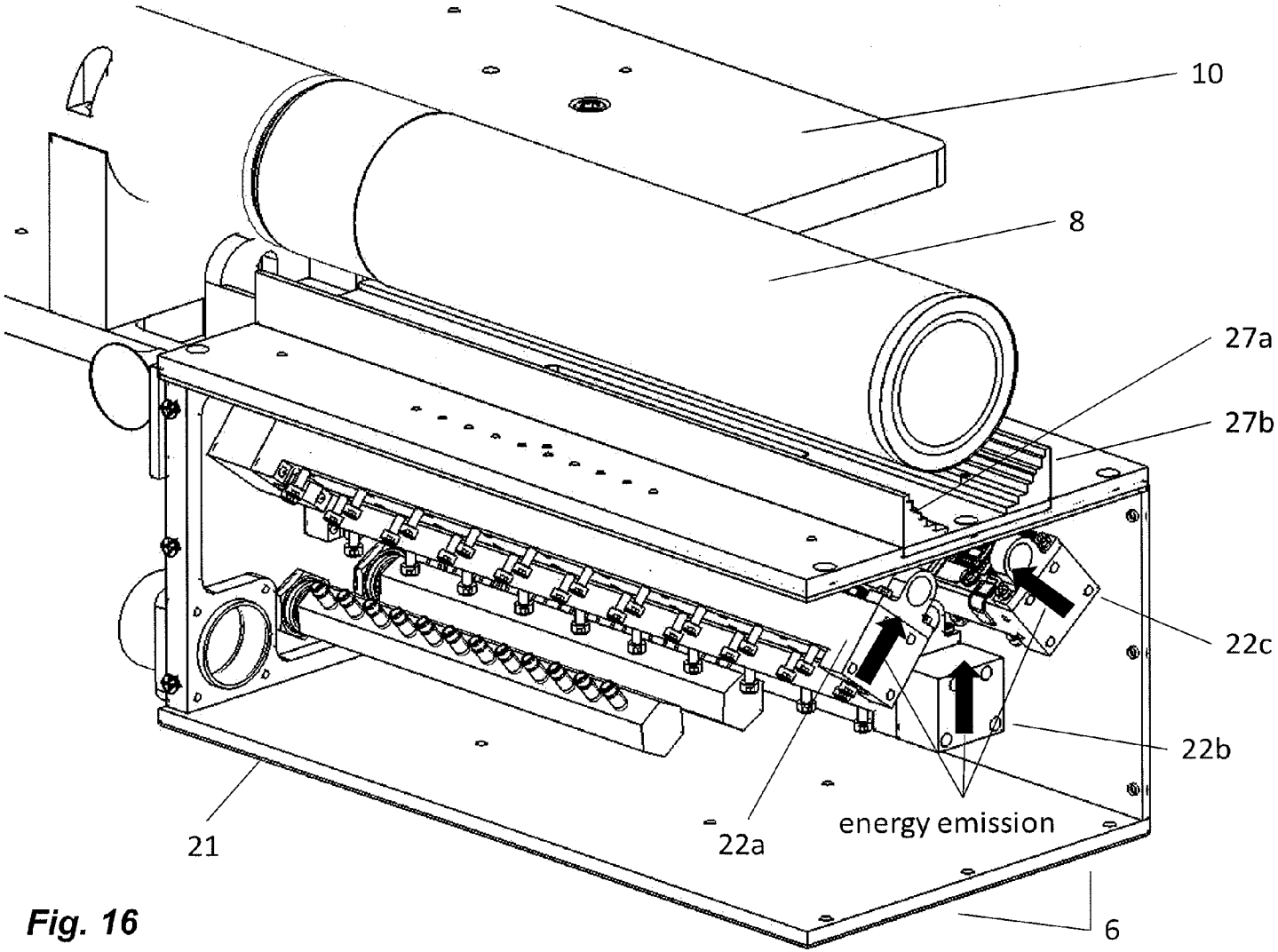
FIG. 16 removes a portion of the energy curing enclosure to more clearly show the energy emitting means.

FIGS. 15 and 16 show the energy curing assembly 6 in detail in relationship to the hollow cylindrical object 8 to be printed. The energy curing assembly 6 comprises a housing 21, which contains the energy emitting means 22*a*, 22*b*, 22*c*. Baffles 27*a*, 27*b* mounted on the top surface of the housing may be used to concentrate the energy emission upon the hollow cylindrical object 8. The energy curing assembly 6 is mounted directly to the carriage mounting plate 10. The term "energy" is understood to include any type of electromagnetic energy suitable for curing of emulsions or resins applied to a substrate including without limitation, ultraviolet. Energy could also include visible light from any suitable source, a non-limiting example being from a light-emitting diode (LED). It will also be understood that energy curing assembly 6 does not need to be mounted to the carriage assembly 2 such that it travels with the object as it is linearly indexed through the printing process. Indeed the energy curing assembly 6 may be fixedly mounted at one end of a print tunnel such that when the object is conveyed through the tunnel it is held over the energy curing assembly 6.

Figure 17:
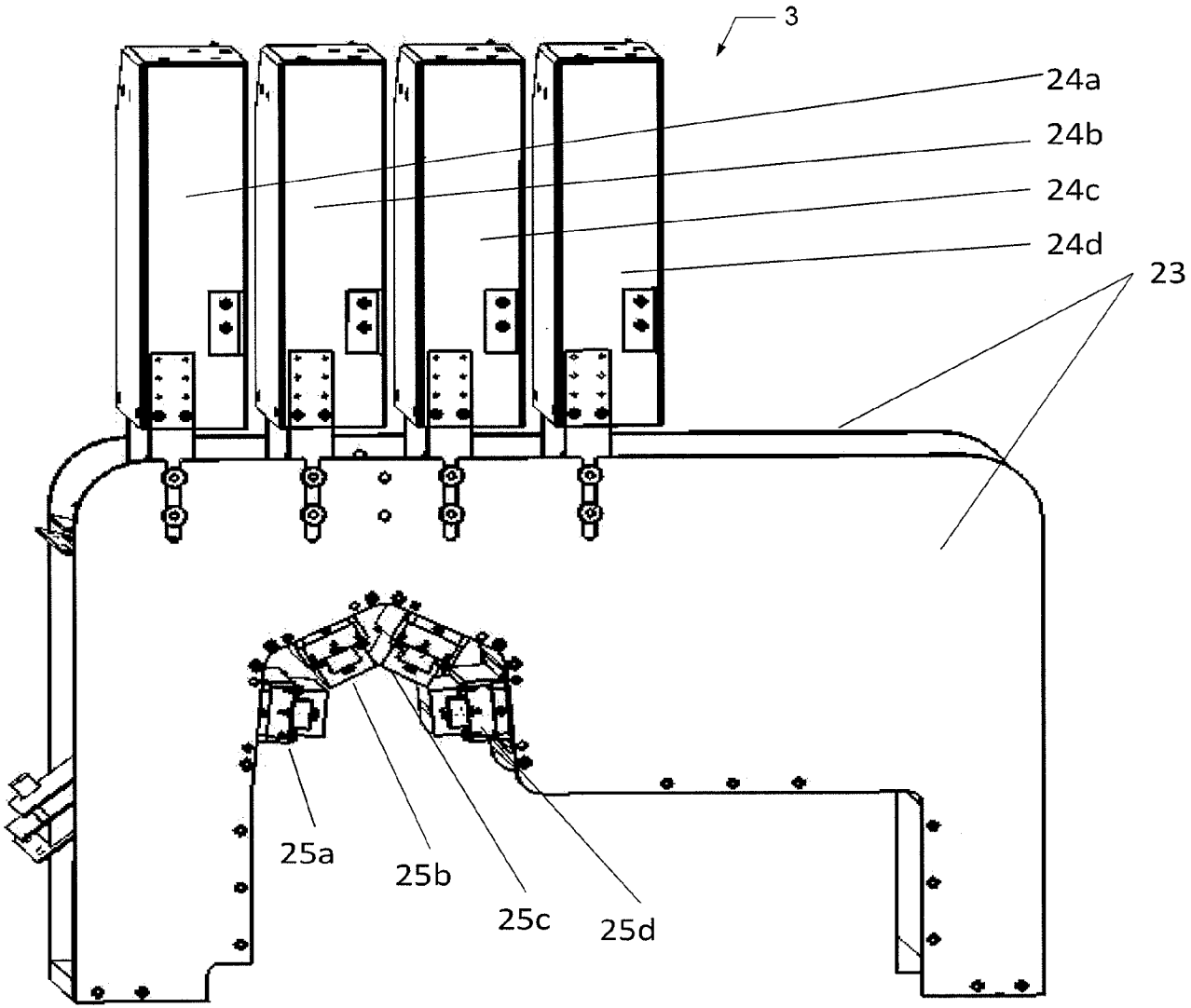
FIG. 17 shows either of the print tunnels in detail.
Figure 18:
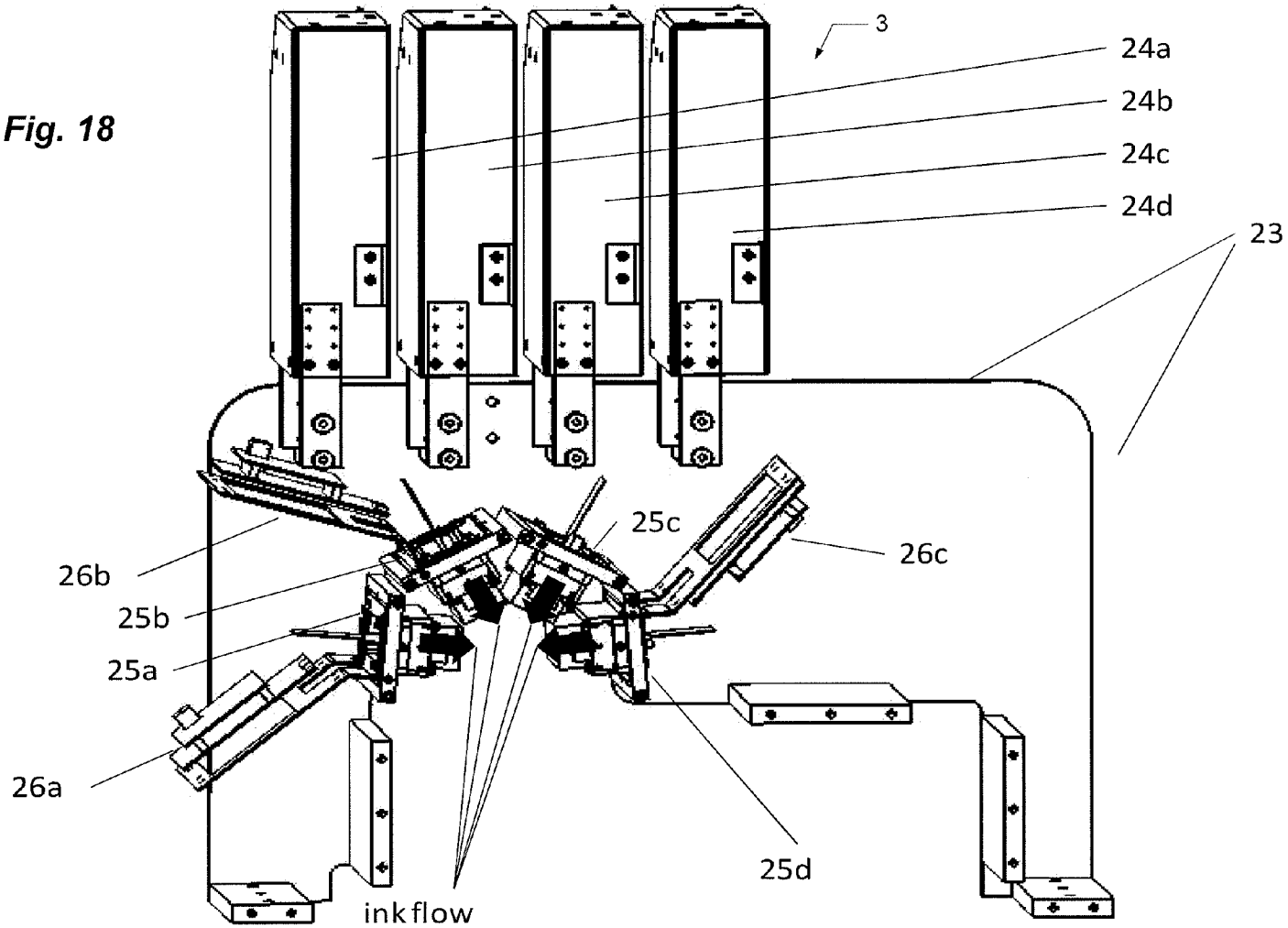
FIG. 18 shows either of the print tunnels with a portion of the print tunnel support removed for clarity.

FIGS. 17 and 18 show an exemplary print tunnel 3 in detail, including the print tunnel support frame 23, ink supply 24*a*, 24*b*, 24*c*, 24*d*, and printheads 25*a*, 25*b*, 25*c*, 25*d*, typically one printhead 25 per color used as would be appreciated by those skilled in the art. Each printhead 25 is controlled through a printed circuit board 26*a*, 26*b*, 26*c* in communication with a computer-based control system (discussed in detail below) that control the deposition of ink that flows from the ink supply 24*a*, 24*b*, 24*c*, 24*d* and onto the hollow cylindrical object 8 to be printed. Printheads 25 are arranged in an arc so that each printhead 25 is the same distance from the surface of the cylindrical object 8.

Figure 19:
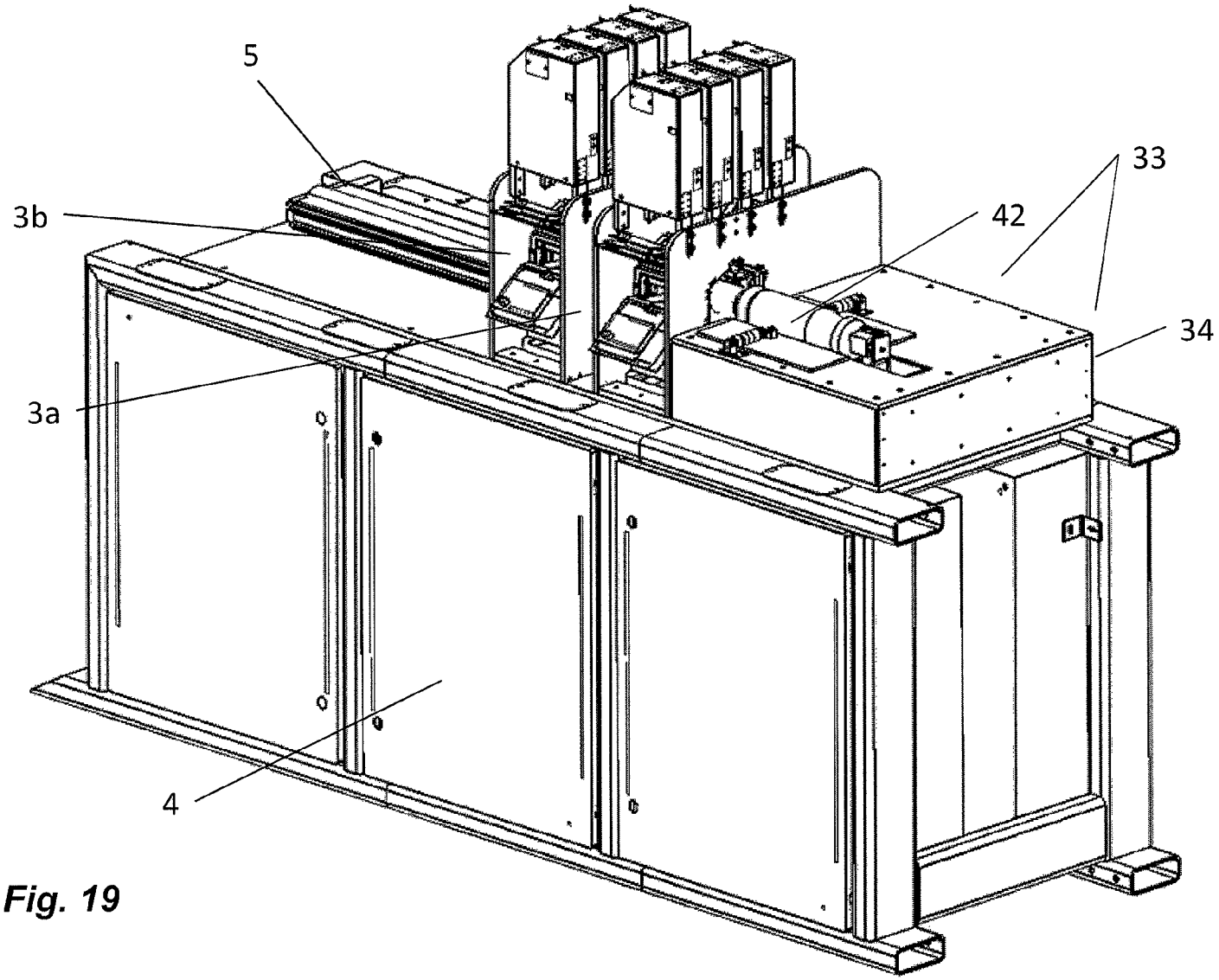
FIG. 19 shows a digital printing apparatus for decorating hollow partially-cylindrical objects, according to a second embodiment of the invention.

A second exemplary embodiment of a printing apparatus is shown in FIG. 19 which depicts a digital printing apparatus for decorating hollow partially-cylindrical objects (or bottles). This version comprises four main, interconnected components: carriage assembly 42, print tunnels 3*a*, 3*b*, support frame 4, and linear slide actuator 5. The linear slide actuator 5 and print tunnels 3*a*, 3*b* are both connected directly to the mounting frame 4. The carriage assembly 42 is in turn mounted directly to the linear slide actuator 5. In this embodiment there exists also an object-centering assembly 33, which attaches directly to the mounting frame 4 via the object-centering support 34.

Figure 20:
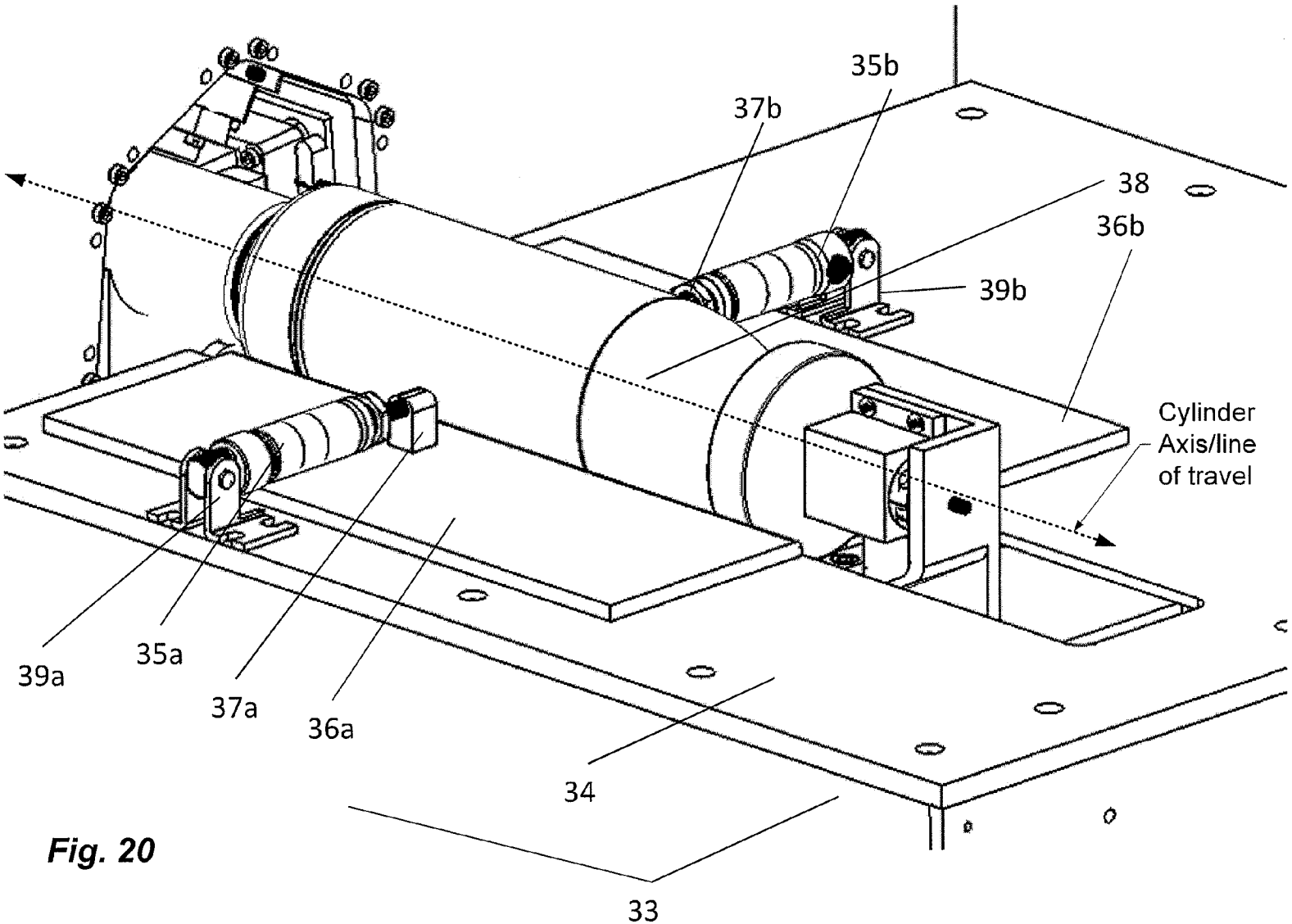
FIG. 20 is a close-up view of the object-centering assembly.
Figure 21:
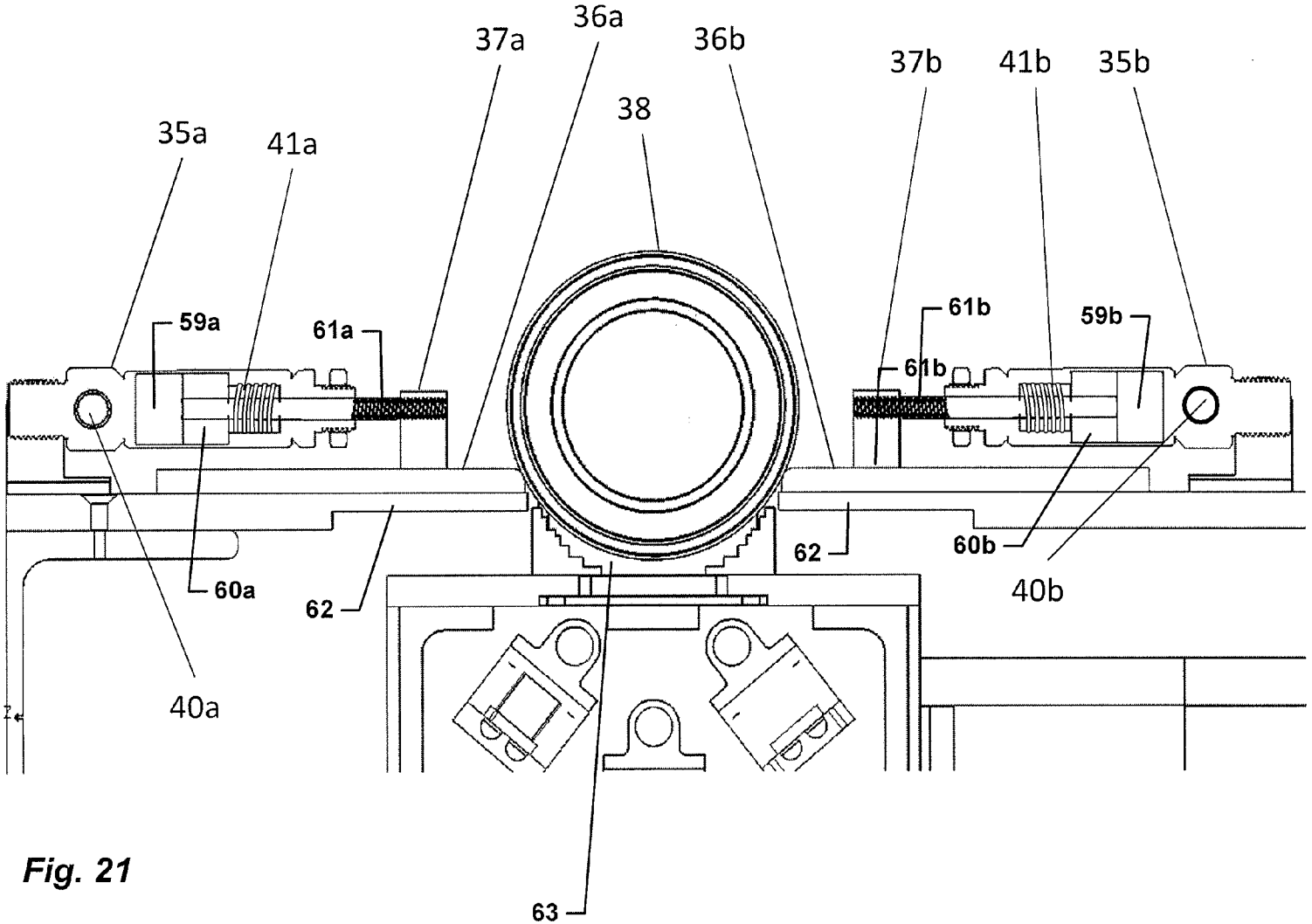
FIG. 21 is a cross-section through the positioning cylinders.

FIG. 20 is a close-up view of the object-centering assembly 33 showing positioning cylinders 35*a*, 35*b* attached directly to the object-centering support 34 via cylinder mounting means 39*a*, 39*b*. Object-centering guides 36*a*, 36*b* are slidably seated upon support surface 62 in which is defined a channel 63 for receiving the partially cylindrical object 38, in turn, connected to the positioning cylinders 35*a*, 35*b* via connection blocks 37*a*, 37*b* and are used to center the hollow partially cylindrical object 38 for precise printing in the print tunnels 3*a*, 3*b*. Positioning cylinders 35*a*, 35*b* may be achieved using pneumatic cylinders shown in detail in FIG. 21 which depicts a cross-section through the positioning cylinders 35*a*, 35*b* showing the cylinder air supply ports 40*a*, 40*b*. Each cylinder defines a chamber 59 in communication with its respective port 40 and in which is slidably seated a plunger 60 having an arm 61 extending outside the cylinder toward the carriage assembly 42. Air pressure applied into the chamber 59 through the port 40 forces the plunger 60 to pneumatically extend the plunger arm 60, thereby forcing the object-centering guides 36*a*, 36*b* through their respective connections against the surface the hollow partially-cylindrical object 38 and so keeps the object 38 centered within the channel 63. The plunger arms 61*a,b* are caused to retract when the air supply at the cylinder air supply ports 40*a*, 40*b* is ceased cylinder springs 41*a*, 41*b* bias the plunger 60 laterally. This centering may be accomplished through a variety of mechanisms other than pneumatic cylinders as would be appreciated by those skilled in the relevant art. Examples of other mechanisms include springs, solenoids, hydraulically actuated plungers, or other suitable mechanisms useful for extension and retraction as indication. Selective application and release of air pressure is rendered by a suitable control system described in detail below. Again the dashed reference line indicates axial alignment of the object 38 along the line of travel.

Figure 22:
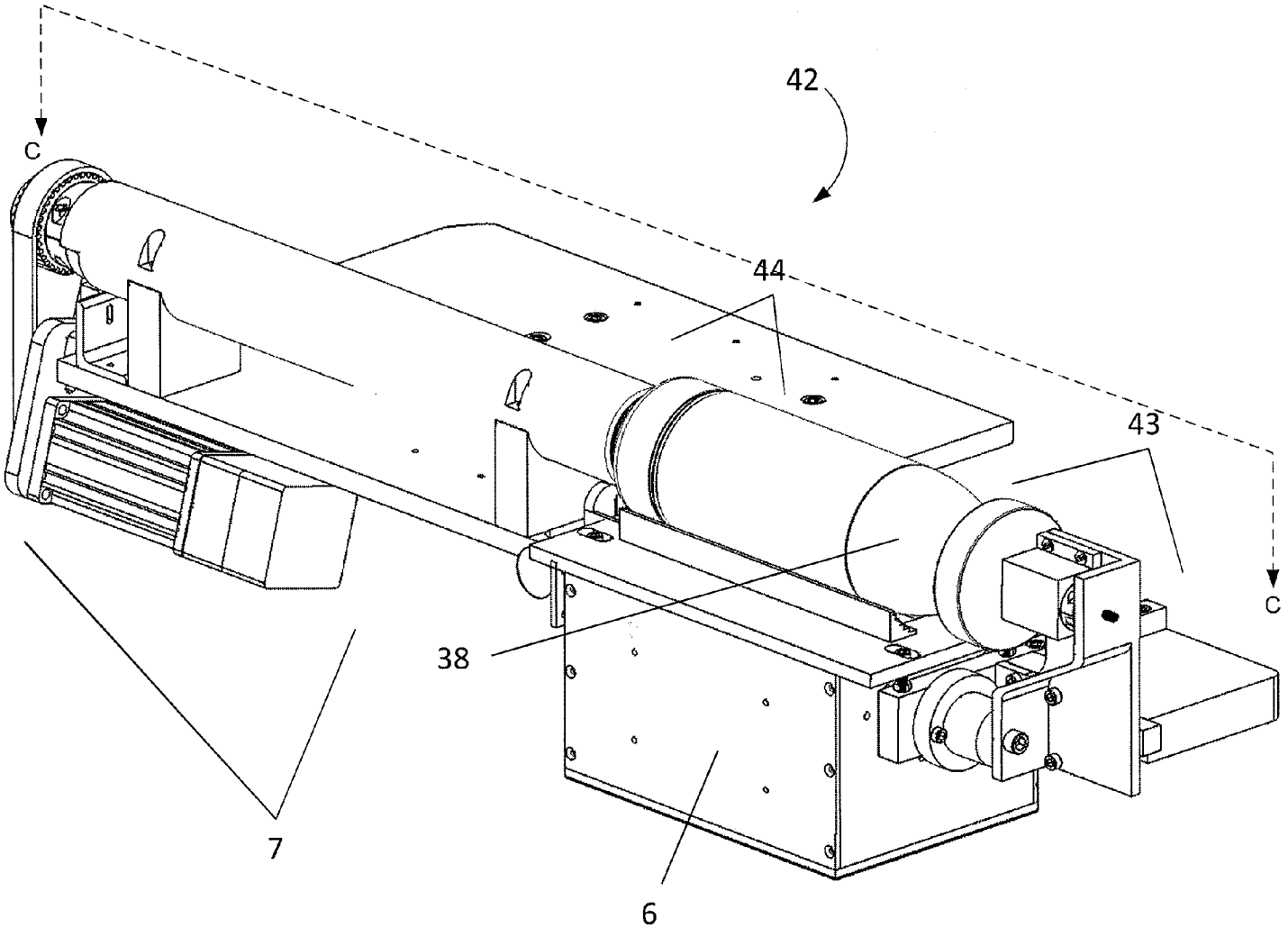
FIG. 22 shows all the components of the carriage assembly.

FIG. 22 shows all the components of the carriage assembly 42, including the rotational drive assembly 7, energy curing assembly 6, hollow partially-cylindrical object 38 to be printed, object clamping assembly 43, and object holding assembly 44.

Figure 23:
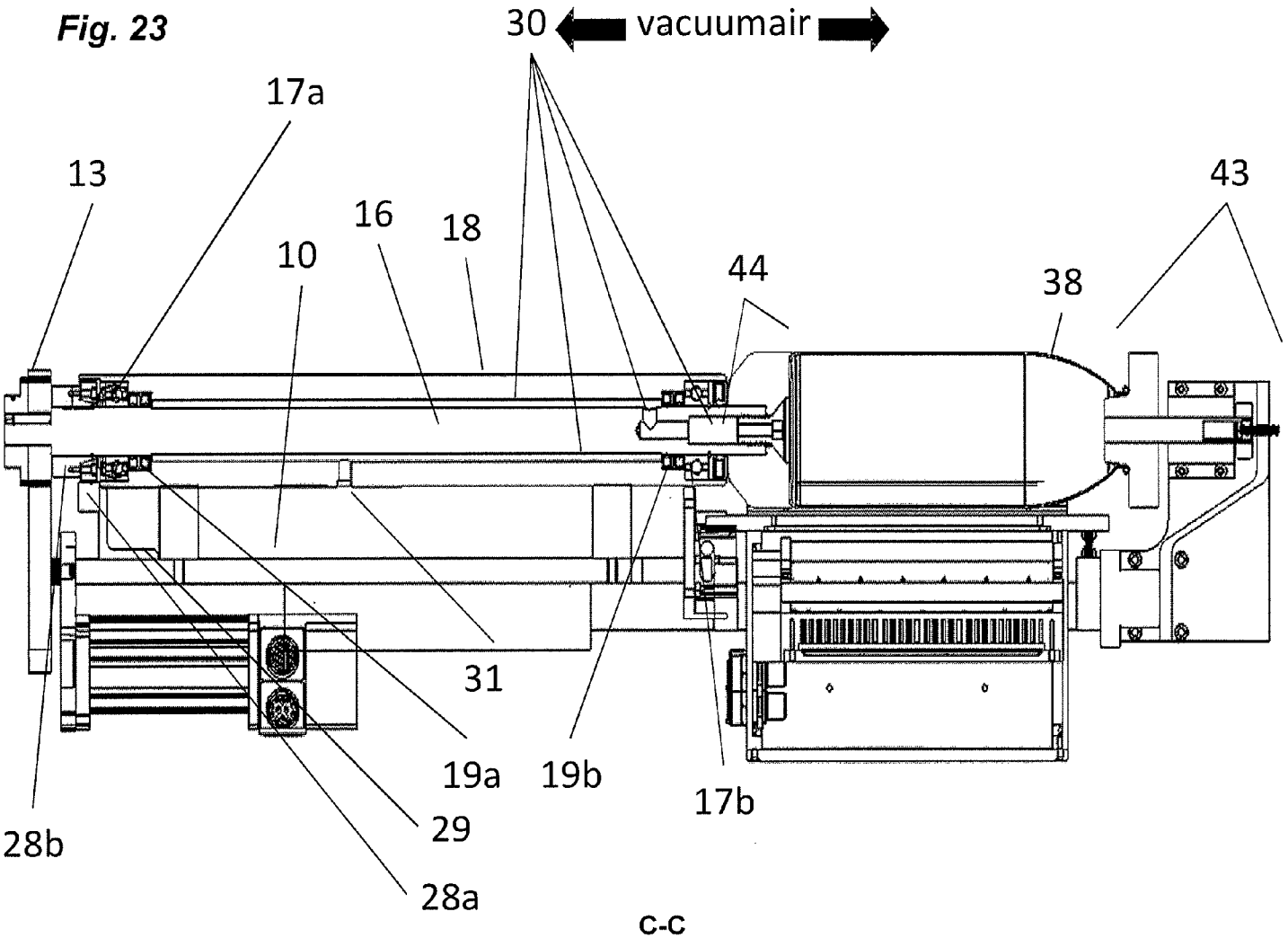
FIG. 23 is a cross-section through the carriage assembly.

FIG. 23 is a cross-section through the carriage assembly 42 shown in FIG. 22 along line C-C wherein an object holding assembly 44 and its interconnection to the driven pulley 13 of the rotational drive assembly 7 via the drive shaft 16. The drive shaft 16 is mounted via bearings 17*a*, 17*b*, which are mounted within the support tube 18, which is mounted to the carriage mounting plate 10 via support blocks 19*a*, 19*b*. The object holding assembly 44 is connected to the drive shaft 16 and supports the hollow partially-cylindrical object 38 to be printed. The object holding assembly 44, drive shaft 16, and support tube 18 are constructed and assembled in such a manner as to create a vacuum/air chamber 30 with an external vacuum/air connection 31 in the sidewall of the support tube 18. As with the previously described embodiment, upon loading the hollow partially-cylindrical object 38 on the object holding assembly 44, a vacuum is applied via the vacuum/air connection 31, creating a vacuum within the vacuum/air chamber 30 that holds the hollow partially-cylindrical object 38 in place. The air/vacuum chamber 30 is isolated from the atmosphere via sealing means 32*a*, 32*b*. A first part of a rotational position sensing means 28*a* is attached to the carriage mounting plate 10 via a sensor mounting means 29. A second part of a rotational position sensing means 28*b* is directly attached to the drive shaft 16; the rotational position sensing means 28*a*, 28*b* is used to control the precise circumferential deposition of ink to the hollow partially-cylindrical object 38. Again, when the object 38 is due to be unloaded, the vacuum is released and air pressure may be applied to assist in disengaging the object 38.

Figure 24:
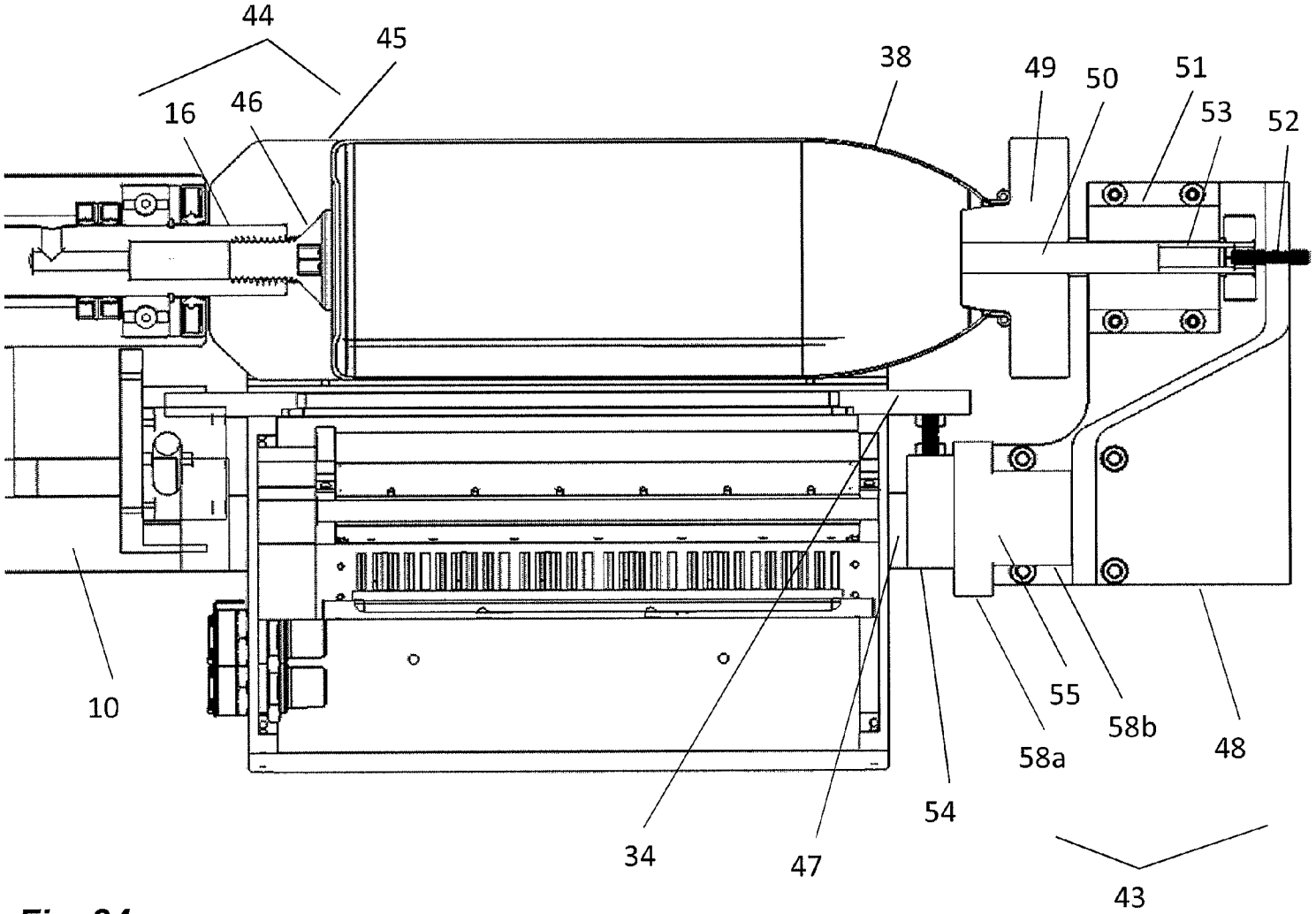
FIG. 24 is a close-up view of a cross-section of the object holding assembly and object clamping assembly.

FIG. 24 is a cross-section along line D-D of the object holding assembly 44 and object clamping assembly 43. The object holding assembly 44 consists of a bottle clamp 45 fixedly mounted to the drive shaft 16 via a clamp fastener 46 that also serves the function of applying air and vacuum to the bottom—or closed end—of the hollow partially-cylindrical object 38. The object clamping assembly 43 consists of the object clamping support bracket 48, which is directly attached to the carriage mounting plate 10 via the clamping support plate 47 at the end of the apparatus. A clamping nosepiece 49—attached by a clamping shaft 50 rotating within a pillow block bearing 51 attached to the clamping support bracket 48—supports the open end of the hollow partially-cylindrical object 38 while allowing said object 38 to rotate freely. The pressure exerted by the clamping nosepiece 49 against the open end of the hollow partially-cylindrical object 38 may be fine tuned via the pressure adjusting screw 52 preloaded against the clamping shaft 50 via the clamping spring 53. A vertically-adjustable cylinder support plate 54 is fastened to the object-centering support 34 and to the clamping cylinder 55, with the opposite end of the clamping cylinder 55 attached to the clamping support bracket 48. The clamping cylinder 55 is actuated via the cylinder connection ports 58*a* and 58*b*, so that when extended the cylinder 55 pushes the object clamping assembly 43 away from the hollow partially-cylindrical object 38, thereby causing the clamping nosepiece 49 to release the hollow partially-cylindrical object 38 so it may be removed from the invention. When the next hollow partially-cylindrical object is placed against the object holding assembly 44, vacuum is applied within the vacuum/air chamber 30, causing the object holding assembly 44 to hold in place the open end of the hollow partially-cylindrical object 38. The clamping cylinder 55 is then actuated such that it retracts, causing the object clamping assembly 43 to be pulled toward the hollow partially-cylindrical object 38, thereby causing the clamping nosepiece 49 to insert into—and position—the open end of the hollow partially cylindrical object 38.

Figure 25:
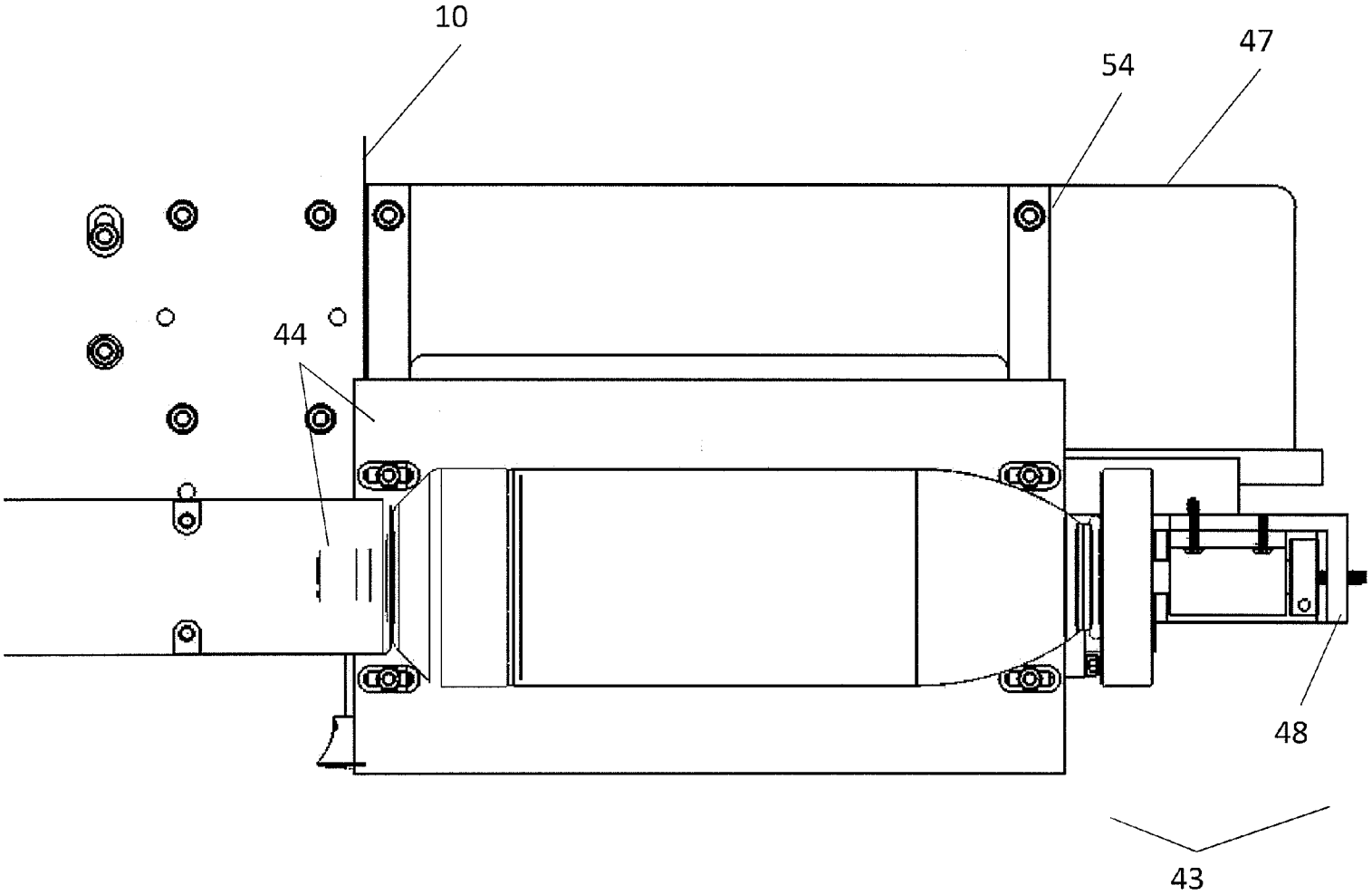
FIG. 25 is a top view of the object clamping assembly and the object holding assembly.

FIG. 25 is a top view of the object clamping assembly 43 and the object holding assembly 44 illustrating the interconnections between the clamping support plate 47, clamping support bracket 48, cylinder support plate 54, and carriage mounting plate 10.

Figure 26:
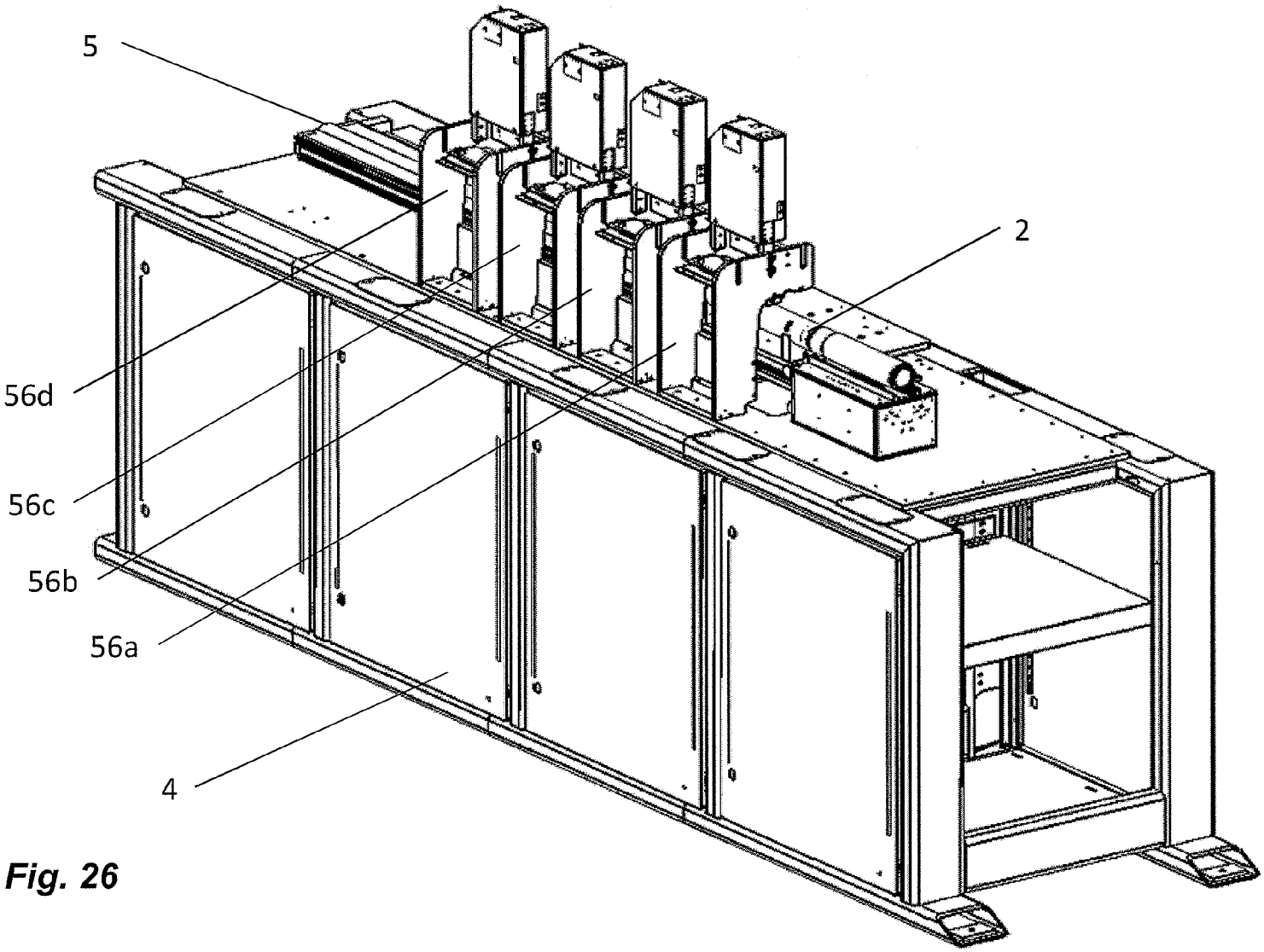
FIG. 26 shows a digital printing apparatus for decorating hollow cylindrical objects, according to a third embodiment of the invention.

In a third exemplary embodiment, described with reference to FIG. 26, a digital printing apparatus for decorating hollow cylindrical objects comprises four main, interconnected components: carriage assembly 2, print stations 56*a*, 56*b*, 56*c*, 56*d* oriented in tandem along the line of travel, mounting frame 4, and linear slide actuator 5. The linear slide actuator 5 and print stations 56*a*, 56*b*, 56*c*, 56*d* are both connected directly to the mounting frame 4. The carriage assembly 2 is in turn mounted directly to the linear slide actuator 5.

Figure 27:
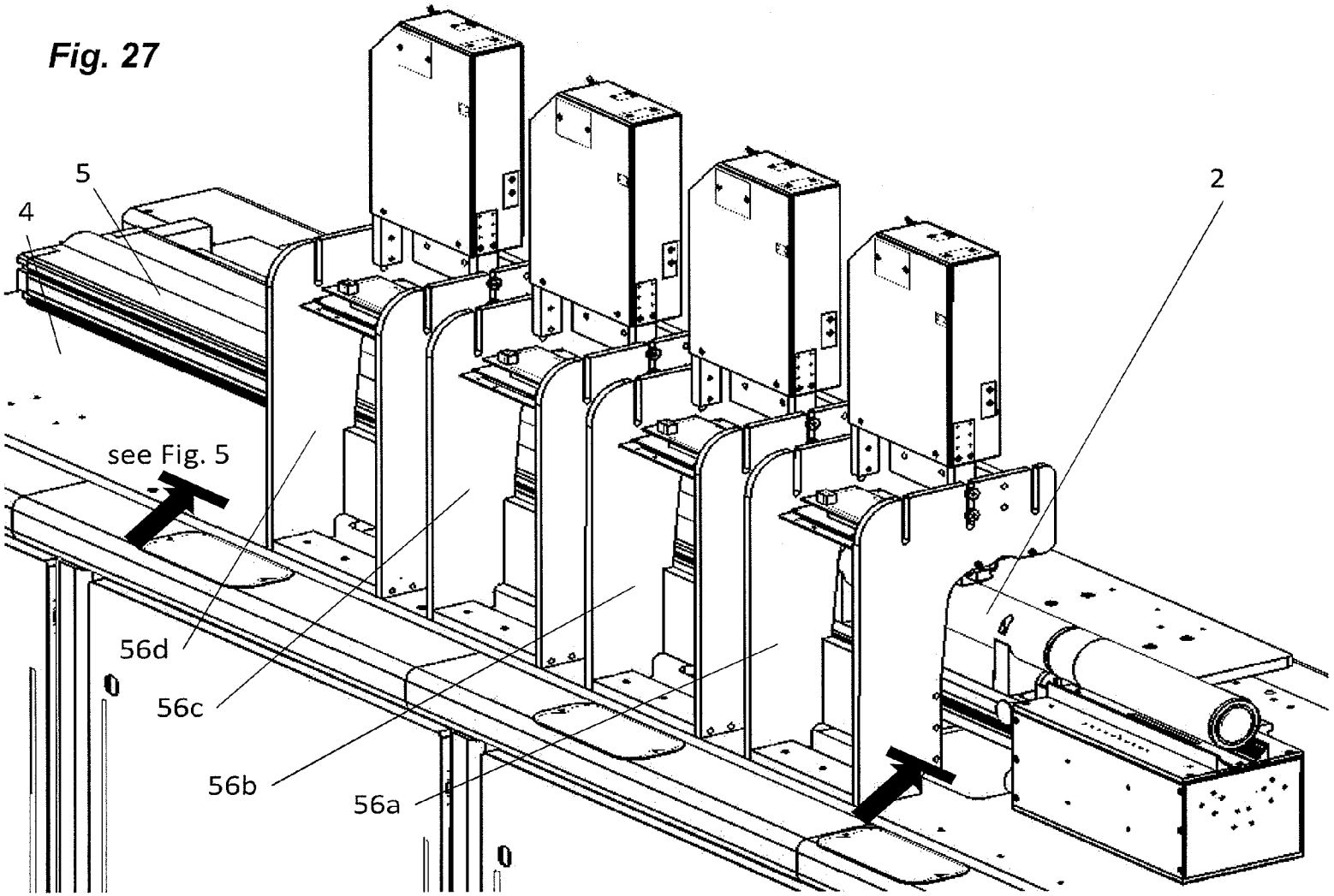
FIG. 27 is a close-up view showing the relationship between the carriage assembly, print stations and mounting frame, as well as the linear slide actuator on which the carriage assembly linearly traverses.
Figure 28:
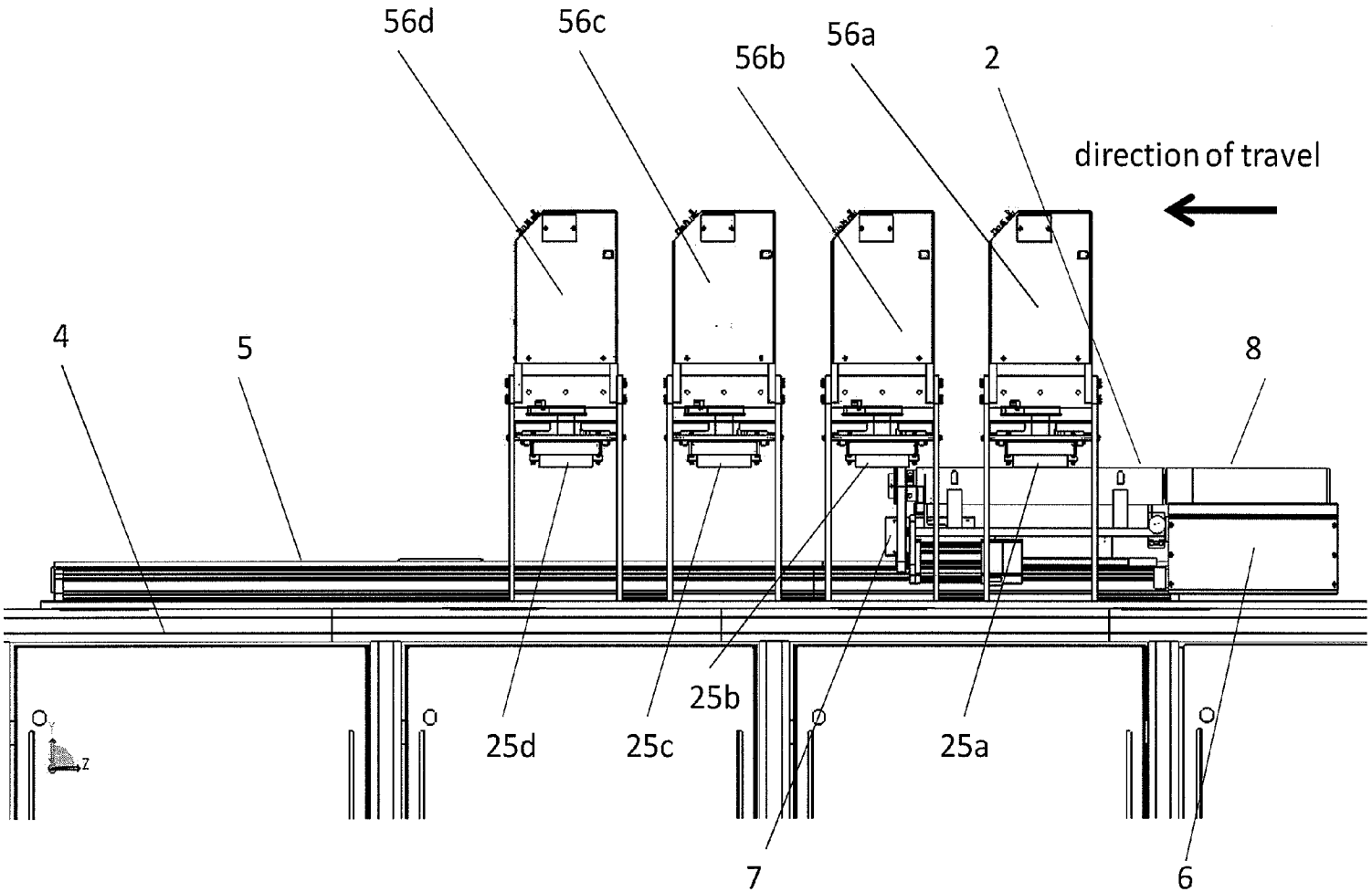
FIG. 28 is a side elevation of the invention showing the energy curing assembly, rotational drive assembly, and hollow cylindrical object to be printed.

FIG. 27 is a perspective view showing the relationship between the carriage assembly 2, print stations 56*a*, 56*b*, 56*c*, 56*d* and mounting frame 4, as well as the linear slide actuator 5 on which the carriage assembly 2 linearly traverses in the same manner as described above. FIG. 28 is a side elevation of the invention showing the energy curing assembly 6, rotational drive assembly 7, and hollow cylindrical object 8 to be printed. The linear slide actuator 5 transports the carriage assembly 2 beneath the print stations 56*a*, 56*b*, 56*c*, 56*d* while the rotational drive assembly 7 rotates the hollow cylindrical object 8 to be printed within said print stations 56*a*, 56*b*, 56*c*, 56*d*. In the preferred operation, the linear slide actuator 5 linearly and continuously advances the carriage assembly 2 while simultaneously rotating the hollow cylindrical object 8 as said carriage 2 passes beneath each of the print stations 56*a*, 56*b*, 56*c*, 56*d*. This allows for quicker printing of the hollow cylindrical object 8 than via indexing and stopping, which nonetheless is also included here as an alternative and is shown via FIG. 29, FIG. 30, and FIG. 31, all described below.

Figure 29:
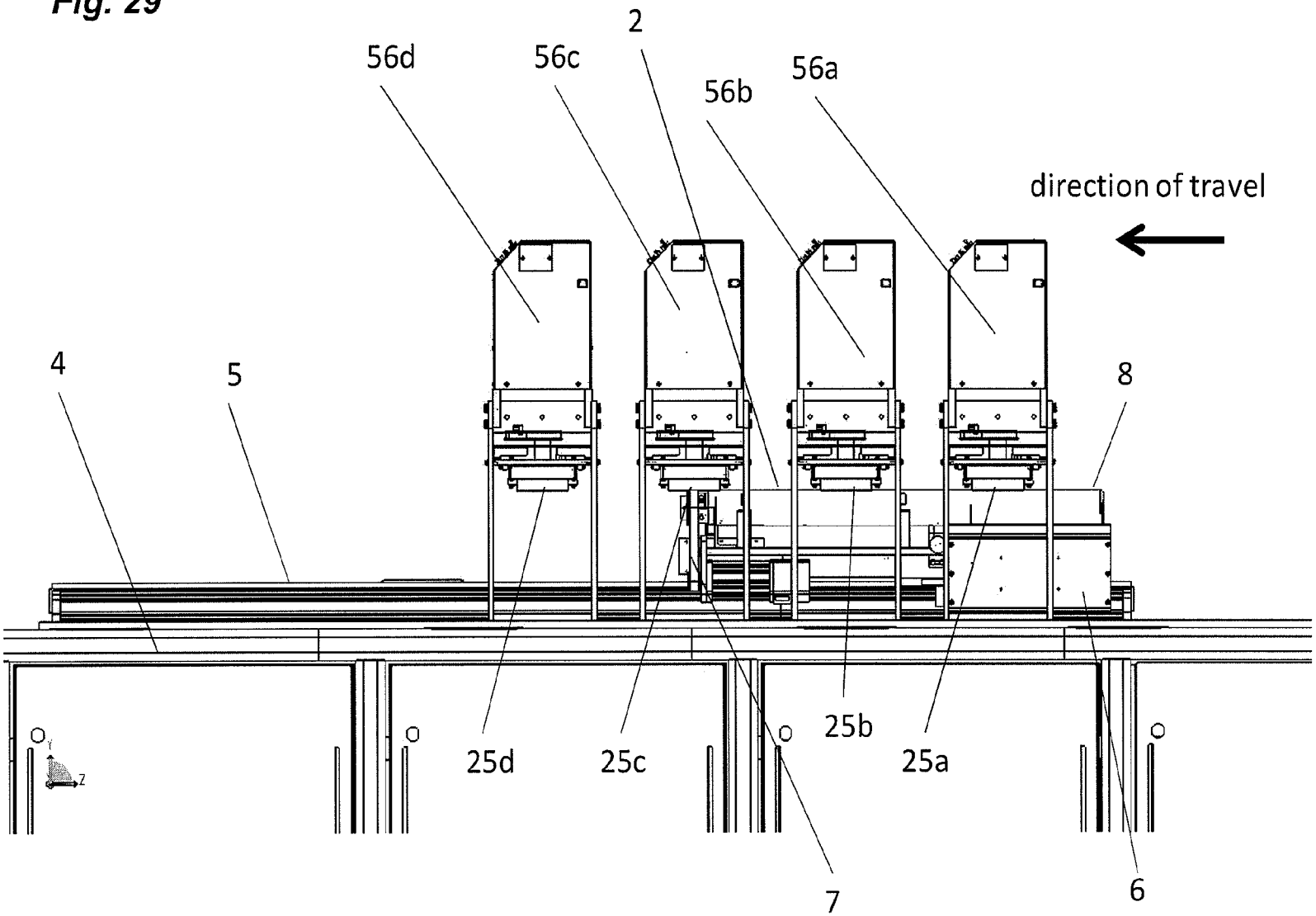
FIG. 29 depicts the carriage assembly linearly advanced by the linear slide actuator.

FIG. 29 depicts the carriage assembly 2 linearly advanced by the linear slide actuator 5 such that in an alternate indexing and stopping operation, only a portion of the hollow cylindrical object 8 to be printed may be printed a length not greater than that of the printheads 25*a*, 25*b*, 25*c*, 25*d* while properly positioned within the first of the print stations 56*a*. During printing, the carriage assembly 2 remains linearly stationary while the rotational drive assembly 7 rotates the mandrel assembly 9, onto which the hollow cylindrical object 8 to be printed is mounted. The number of rotations is dependent upon the desired resolution in dots per inch of the image to be printed. Meanwhile the energy curing assembly 6 applies energy to the hollow cylindrical object 8 to be printed after printing to either partially cure the print to prevent running of the ink prior to further printing or to completely cure the ink as a finished product if appropriate and desired.

Figure 30:
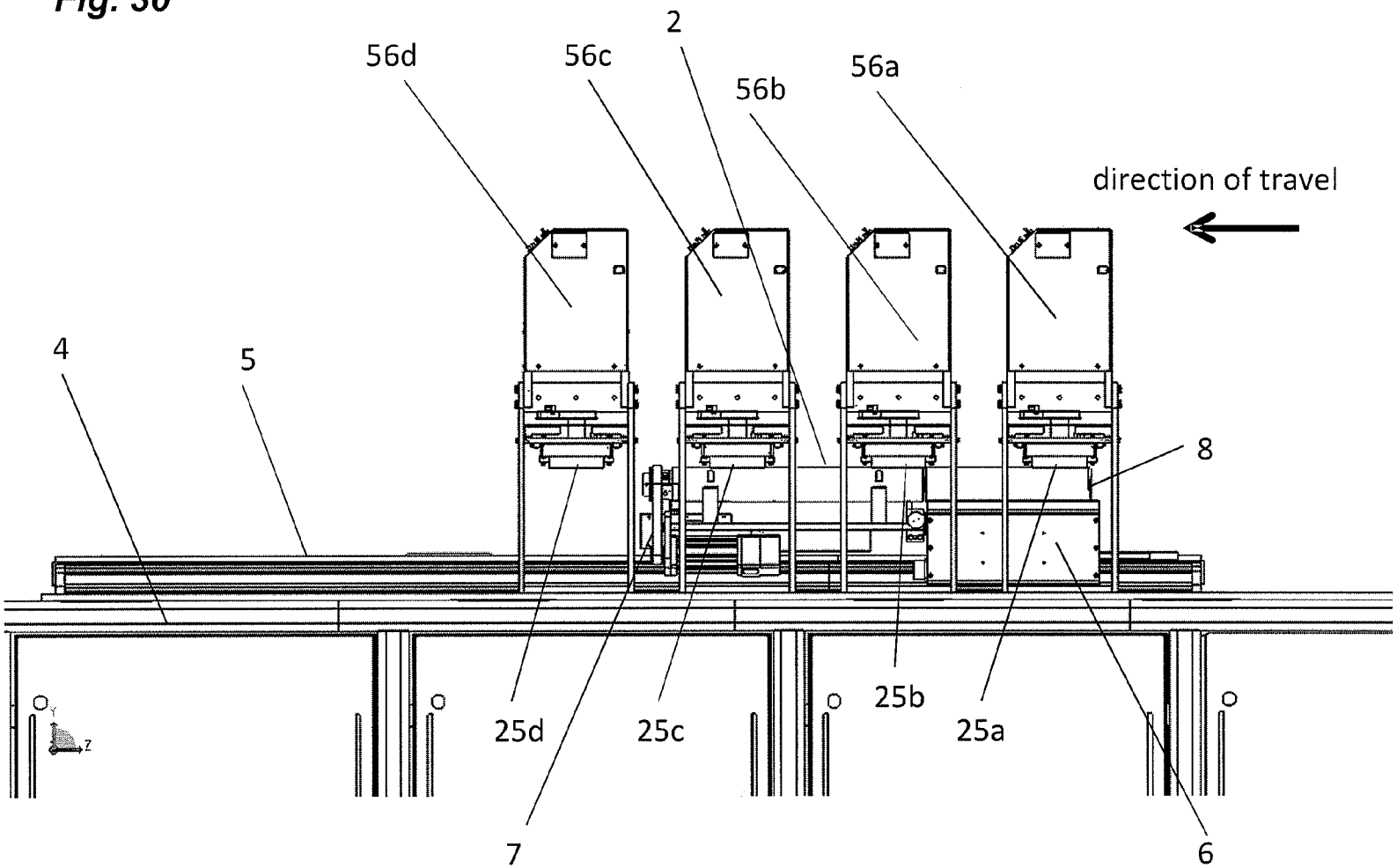
FIG. 30 illustrates the carriage assembly further linearly advanced.

FIG. 30 illustrates the carriage assembly 2 further linearly advanced by the linear slide actuator 5 sufficiently to complete the printing of the hollow cylindrical object 8 to be printed in the first of the print stations 56*a*. The number of times necessary for the carriage assembly 2 to be linearly indexed by the linear slide actuator 5 is dependent upon the length of the hollow cylindrical object 8 to be printed compared to the available length of the printheads 25*a*, 25*b*, 25*c*, 25*d*.

Figure 31:
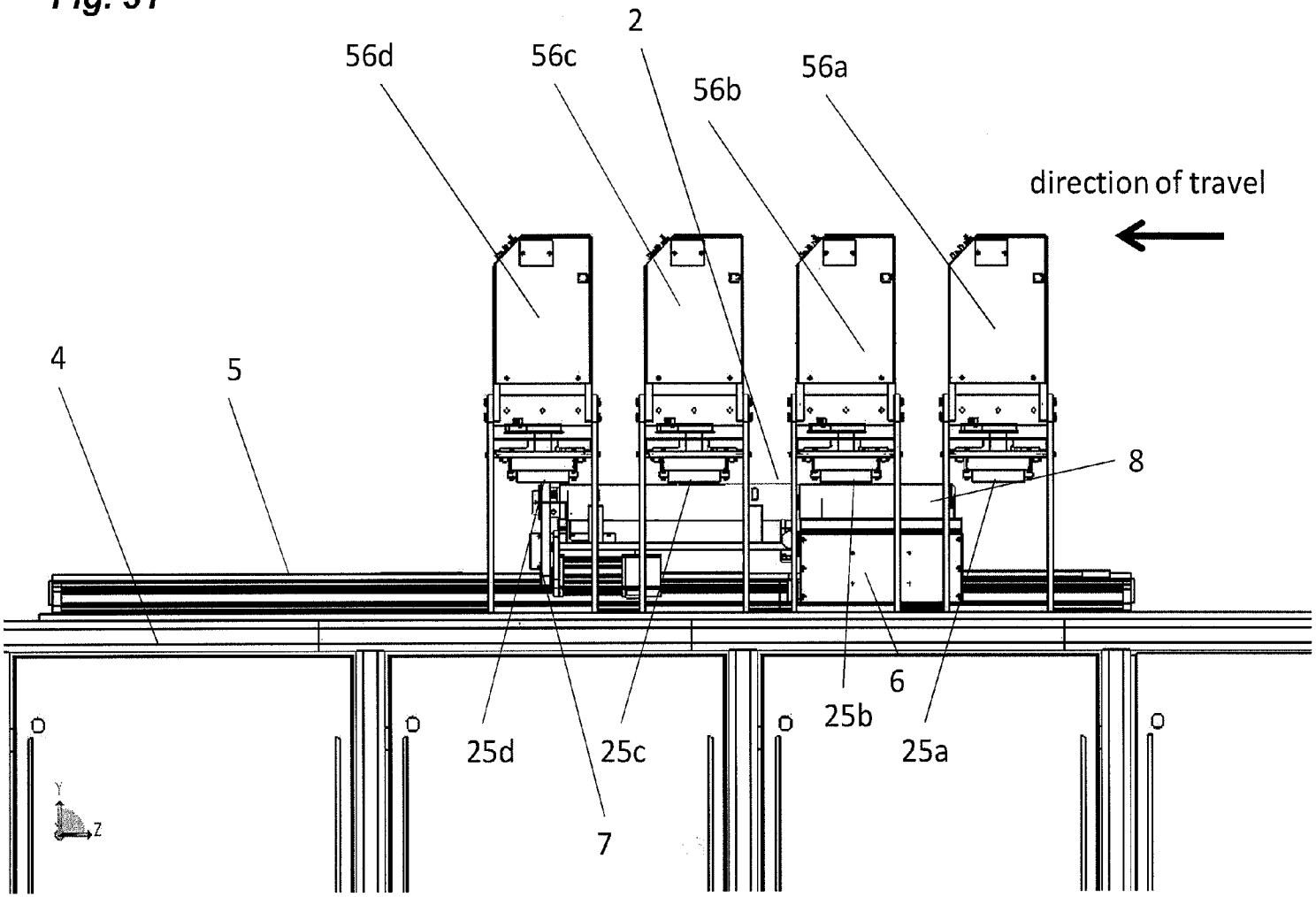
FIG. 31 shows the carriage assembly yet further linearly advanced.

FIG. 31 shows the carriage assembly 2 further linearly advanced by the linear slide actuator 5 sufficiently to begin printing the hollow cylindrical object 8 to be printed within the second of the print stations 56*b*. The number of print stations 56*a*, 56*b*, 56*c*, 56*d* need not be limited to the number shown in the figures, but can be as many as dictated by the number of colors to be printed, as the number of colors in the current embodiment is limited to four. Other media besides ink may be printed on the hollow cylindrical object 8 to be printed and may include, but is not limited to, overcoat varnish, size coating, base coating, and any applicable protective or decorative fluid used to enhance the appearance of, or afford protection of, the hollow cylindrical object 8 to be printed, and/or to improve adhesion of the ink to be used in its printing.

Figure 32:
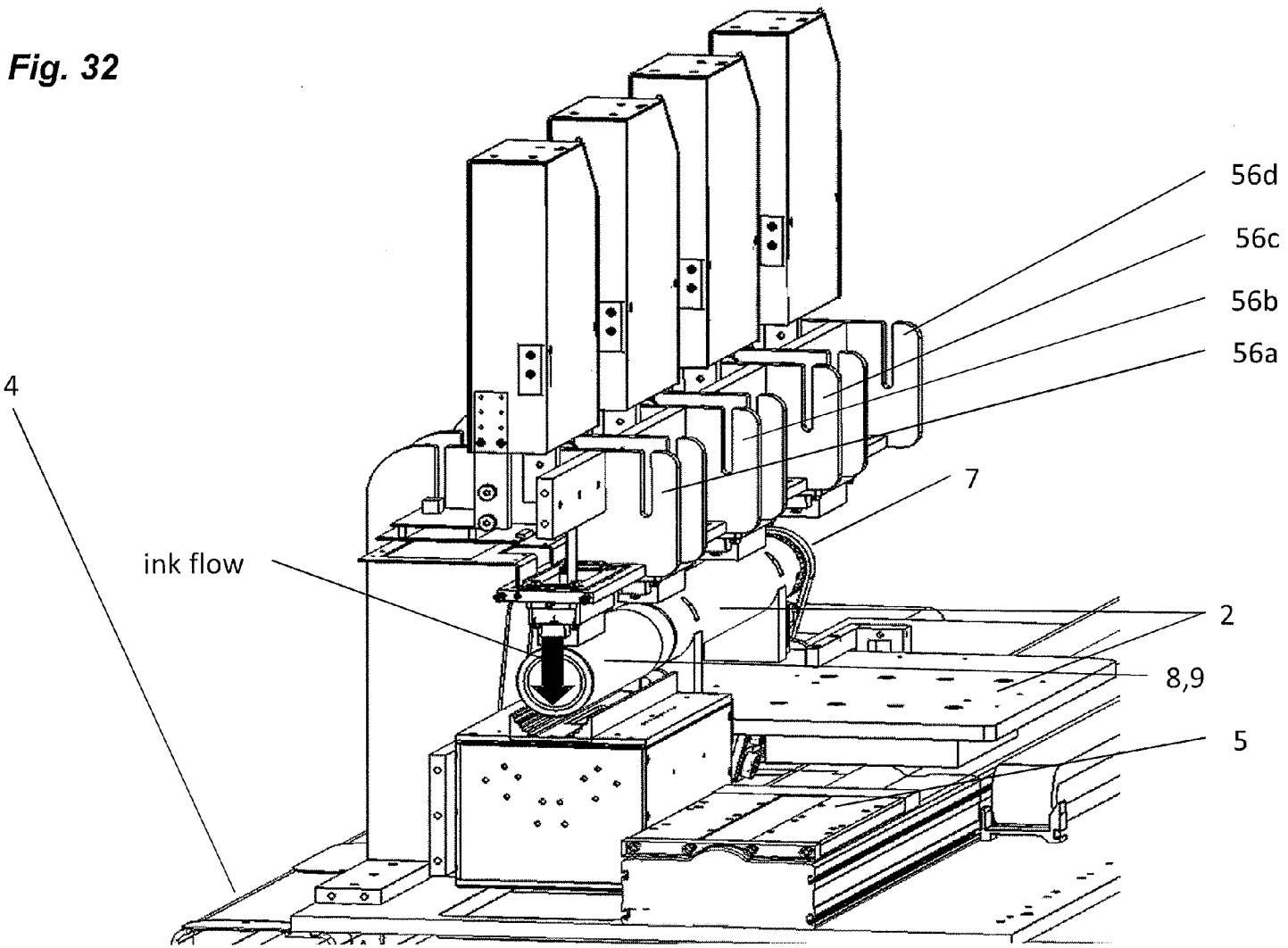
FIG. 32 shows the interconnection of the major components.

In FIG. 32 is shown the interconnection of the major components, namely the linear slide actuator 5 fastened to the mounting frame 4, the carriage assembly 2 connected to the linear slide actuator 5 and the print stations 56*a*, 56*b*, 56*c*, 56*d* fastened to the mounting frame 4.

Figure 33:
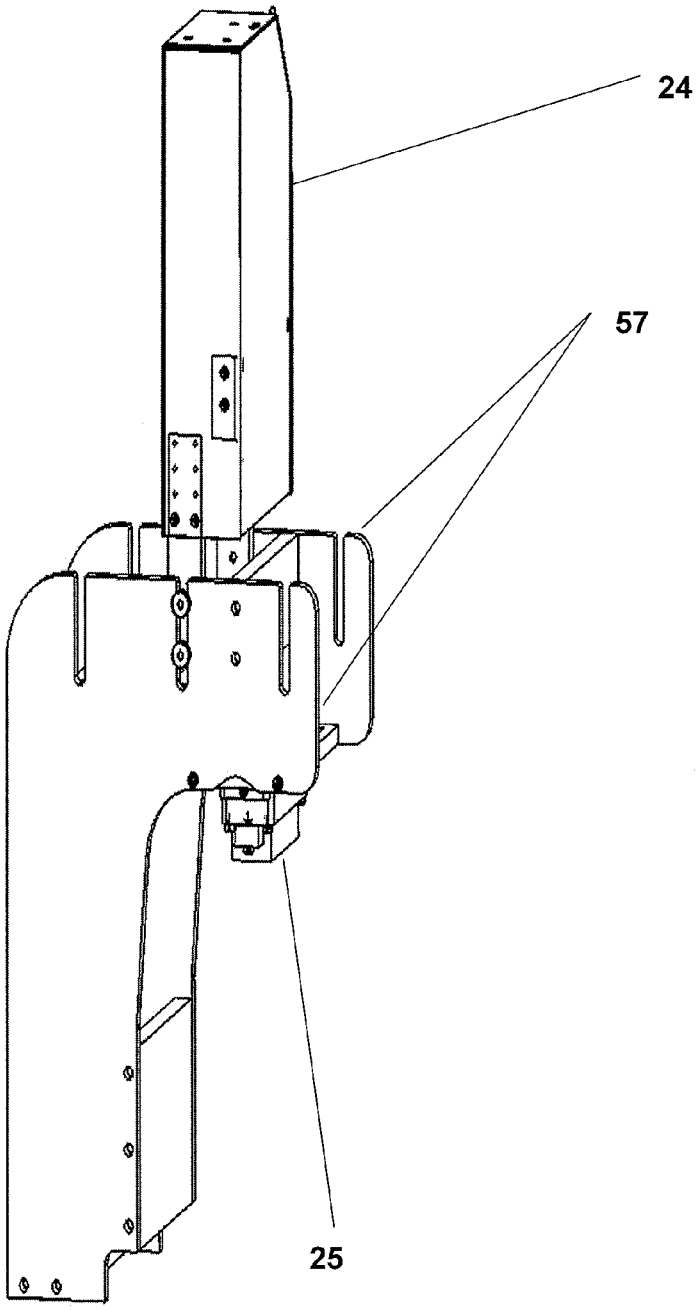
FIG. 33 shows any of the print stations in detail.
Figure 34:
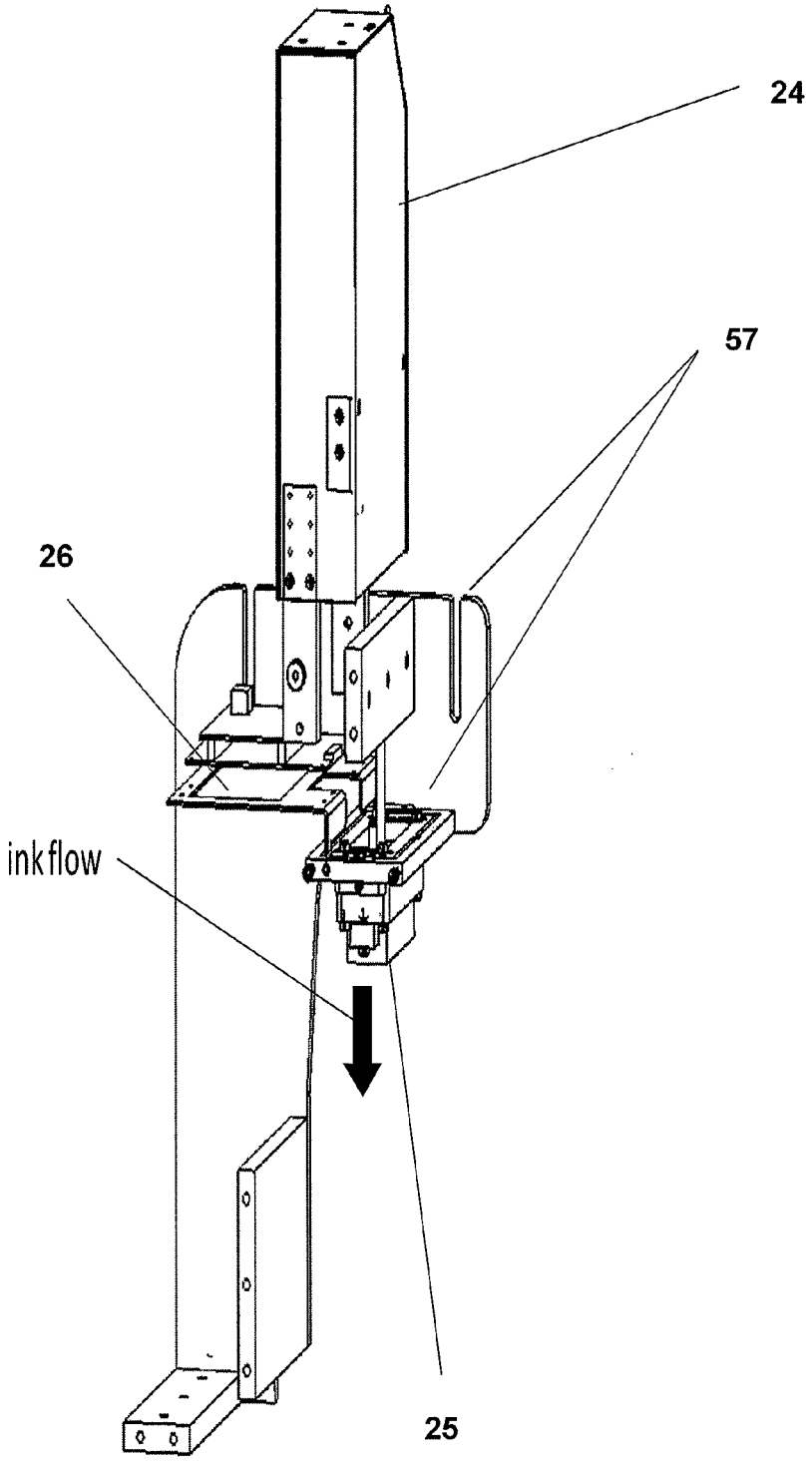
FIG. 34 shows any of the print stations with a portion of the print tunnel support removed.
Figure 35:
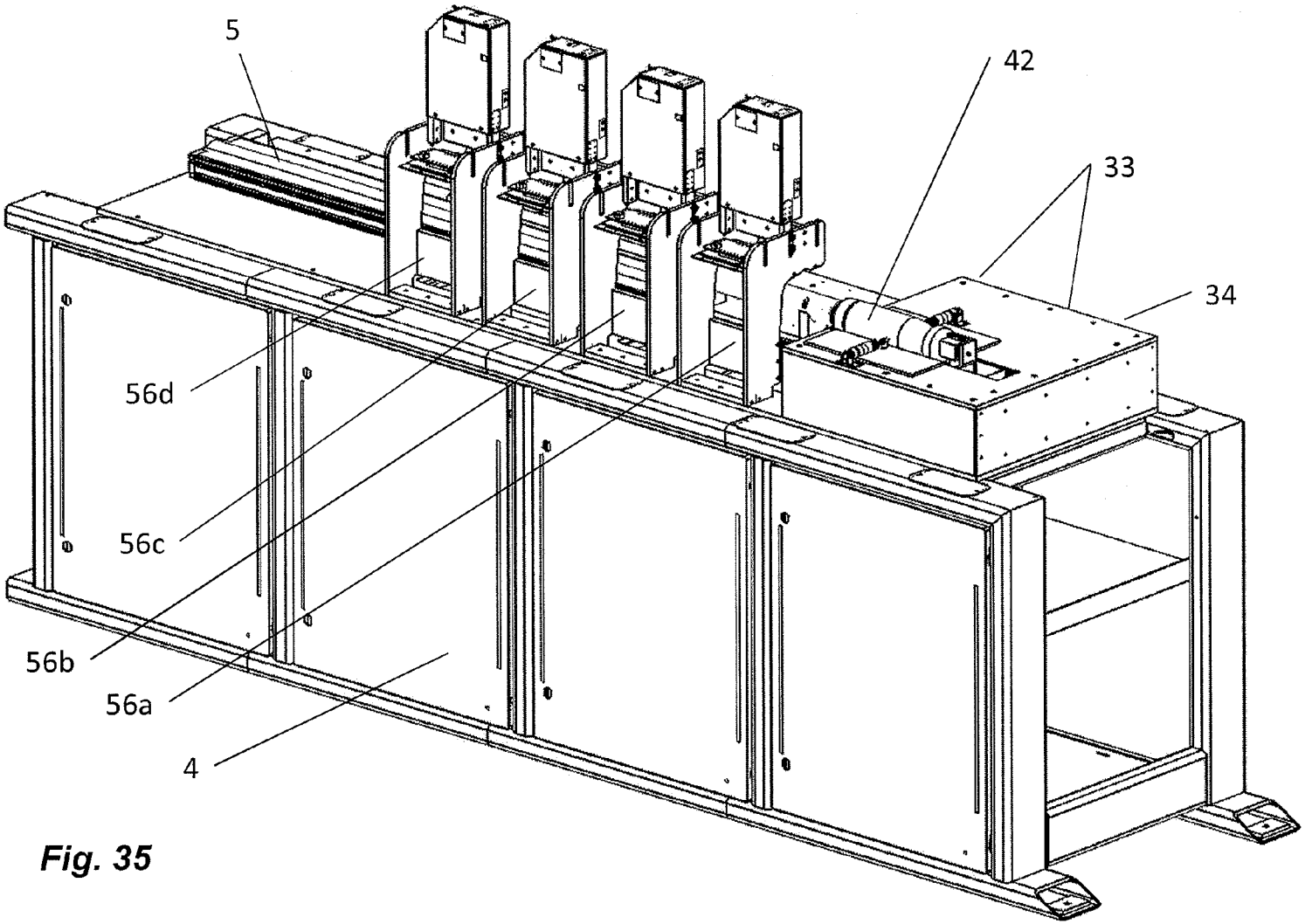
FIG. 35 shows a digital printing apparatus for decorating hollow partially-cylindrical objects, according to a fourth embodiment of the invention.

FIG. 33 shows an exemplary print station 56 in detail, including any of the print station supports 57, ink supply 24*a-d* and printheads 25*a-d*. FIG. 35 shows any of the print stations 56*a*, 56*b*, 56*c*, 56*d* with a portion of the print station supports 57*a-d* removed to reveal the any of the printed circuit boards 26*a*, 26*b*, 26*c*, 26*d* that control the deposition of ink that flows from the ink supply means 24*a*, 24*b*, 24*c*, 24*d* and onto the hollow cylindrical object 8 (not shown) to be printed.

In yet another embodiment, FIG. 36 shows a digital printing apparatus for decorating hollow partially-cylindrical objects similar to the apparatus described above except with print stations 56*a*, 56*b*, 56*c*, 56*d*, aligned in tandem along the line of travel of the carriage assembly 42.

Functions of the apparatus described above are controlled through instructions executed by a computer-based control system which may be housed in the support frame 4. A control system suitable for use with all embodiments described above includes, for example, one or more processors that are connected to a communication bus. The computer system can also include a main memory, preferably a random access memory (RAM), and can also include a secondary memory. The secondary memory can include, for example, a hard disk drive and/or a removable storage drive. The removable storage drive reads from and/or writes to a removable storage unit in a well-known manner. The removable storage unit, represents a floppy disk, magnetic tape, optical disk, and the like, which is read by and written to by the removable storage drive. The removable storage unit includes a computer usable storage medium having stored therein computer software and/or data.

The secondary memory can include other similar means for allowing computer programs or other instructions to be loaded into the computer system. Such means can include, for example, a removable storage unit and an interface. Examples of such can include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

Computer programs (also called computer control logic) are stored in the main memory and/or secondary memory. Computer programs can also be received via the communications interface. Such computer programs, when executed, enable the computer system to perform certain features of the present invention as discussed herein. In particular, the computer programs, when executed, enable a control processor to perform and/or cause the performance of features of the present invention. Accordingly, such computer programs represent controllers of the computer system of a transceiver.

In an embodiment where the invention is implemented using software, the software can be stored in a computer program product and loaded into the computer system using the removable storage drive, the memory chips or the communications interface. The control logic (software), when executed by a control processor, causes the control processor to perform certain functions of the invention as described herein.

In another embodiment, features of the invention are implemented primarily in hardware using, for example, hardware components such as application specific integrated circuits (ASICs) or field-programmable gated arrays (FPGAs). Implementation of the hardware state machine so as to perform the functions described herein will be apparent to persons skilled in the relevant art(s). In yet another embodiment, features of the invention can be implemented using a combination of both hardware and software.

As described above and shown in the associated drawings, the present invention comprises an apparatus for apparatuses for printing on generally cylindrical objects and related methods. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An ink jet printer for printing on an object having at least a portion that is cylindrical, said cylindrical portion having a surface defined by points at a fixed radius from an axis, said printer comprising:

one or more printheads, each said printhead in communication with a fluid supply and fixedly positioned above a line of travel and controlled to selectively deposit fluid upon a surface of said object in accordance with a predetermined image;

a curing device located along said line of travel and configured to emit energy suitable to cure fluid deposited upon the surface of said object; and a carriage assembly mounted to a linear actuator, said linear actuator configured to move said carriage assembly linearly along said line of travel, said carriage assembly configured to hold said object such that said axis is aligned axially along said line of travel and to rotate said object about said axis, and wherein said linear actuator moves said carriage assembly to position said object relative to said one or more printheads, and said carriage assembly rotates said object relative to said one or more printheads, and wherein said linear actuator moves said carriage assembly to position said object relative to said curing device, and said carriage assembly rotates said object about said axis relative to said curing device.

2. The ink jet printer of claim 1, further comprising a generally cylindrical mandrel having a free end dimensioned to be inserted into a hollow cylindrical object and supported by said carriage assembly such that it is axially aligned along said line of travel, said mandrel being coupled to a rotating drive shaft.

3. The ink jet printer of claim 2, wherein said mandrel further defines a chamber having an opening at said free end, said chamber in fluid communication with a conduit such that a substantial vacuum may be created within said chamber sufficient to draw said object against said free end.

4. The ink jet printer of claim 1, wherein said one or more printheads comprise a print tunnel including at least four printheads arranged in an arch above said line of travel.

5. The ink jet printer of claim 4, further comprising at least two print tunnels arrayed in tandem along said line of travel.

6. The ink jet printer of claim 4, further comprising a generally cylindrical mandrel having a free end dimensioned to be inserted into a hollow cylindrical object and supported by said carriage assembly such that it is axially aligned along said line of travel, said mandrel being coupled to a rotating drive shaft.

7. The ink jet printer of claim 6, wherein said mandrel further defines a chamber having an opening at said free end, said chamber in fluid communication with a conduit such that a substantial vacuum may be created within said chamber sufficient to draw said object against said free end.

8. The ink jet printer of claim 1, wherein said one or more printheads are arrayed in tandem along the line of travel.

9. The ink jet printer of claim 8, further comprising a generally cylindrical mandrel having a free end dimensioned to be inserted into a hollow cylindrical object and supported by said carriage assembly such that it is axially aligned along said line of travel, said mandrel being coupled to a rotating drive shaft.

10. The ink jet printer of claim 9, wherein said mandrel further defines a chamber having an opening at said free end, said chamber in fluid communication with a conduit such that a substantial vacuum may be created within said chamber sufficient to draw said object against said free end.

11. The ink jet printer of claim 1, wherein said carriage assembly further comprises opposing clamping and holding assemblies configured to hold a partially cylindrical object axially aligned with the line of travel, said holding assembly being coupled to a rotating drive shaft.

12. The ink jet printer of claim 11, wherein said carriage assembly further comprises a centering guide for maintaining lateral alignment of said object.

13. The ink jet printer of claim 11, wherein said one or more printheads comprise a print tunnel including at least four printheads arranged in an arch above said line of travel.

14. The ink jet printer of claim 11, further comprising at least two print tunnels arrayed in tandem along said line of travel.

15. The ink jet printer of claim 11, wherein said holding assembly comprises a tube terminating a holding plate for engaging one end of said cylindrical object, and wherein said tube defines a chamber having an opening in the surface of said holding plate, said chamber in fluid communication with a conduit such that a substantial vacuum may be created within said chamber sufficient to draw said object against said holding plate.

16. The ink jet printer of claim 15, wherein said carriage assembly further comprises a centering guide for maintaining lateral alignment of said object.

17. The ink jet printer of claim 16, wherein said one or more printheads comprise a print tunnel including at least four printheads arranged in an arch above said line of travel.

18. The ink jet printer of claim 17, further comprising at least two print tunnels arrayed in tandem along said line of travel.

* * * * *